US012789075B2

(12) United States Patent
Sévigny et al.

(10) Patent No.: US 12,789,075 B2
(45) Date of Patent: Nov. 10, 2026

(54) ICE RINK STRUCTURE AND METHOD FOR CONSTRUCTING AN ICE RINK USING THE SAME

(71) Applicant: 9248-8071 QUÉBEC INC., St-Roch-de-l'Achigan (CA)

(72) Inventors: Jérôme Sévigny, St-Roch-de-l'Achigan (CA); Michael Gagnon, St-Roch-de-l'Achigan (CA)

(73) Assignee: 9248-8071 QUÉBEC INC., St-Roch-de-l'Achigan (CA)

( * ) Notice: Subject to any disclaimer, the term of this patent is extended or adjusted under 35 U.S.C. 154(b) by 345 days.

(21) Appl. No.: 18/416,201

(22) Filed: Jan. 18, 2024

(65) Prior Publication Data

US 2024/0245980 A1 Jul. 25, 2024

Related U.S. Application Data

(60) Provisional application No. 63/480,527, filed on Jan. 19, 2023.

(51) Int. Cl.
*A63C 19/10* (2006.01)
*E01C 13/10* (2006.01)

(52) U.S. Cl.
CPC ..... *A63C 19/10* (2013.01); *E01C 13/102* (2013.01)

(58) Field of Classification Search
CPC ..... A63C 19/10; E01C 13/102
See application file for complete search history.

(56) References Cited

U.S. PATENT DOCUMENTS 3,012,596 A 12/1961 Skolout
3,495,415 A * 2/1970 MacCracken ..... F25C 3/02 62/235
3,797,049 A 3/1974 De
3,933,002 A * 1/1976 Vickery ..... E01C 13/102 62/235
3,983,713 A * 10/1976 MacCracken ..... A63C 19/12 62/235

(Continued)

FOREIGN PATENT DOCUMENTS

CA 1127677 A 7/1982
CA 2632300 A1 12/2009

(Continued)

*Primary Examiner* — Audrey B. Walter
(74) *Attorney, Agent, or Firm* — Mueting Raasch Group

(57) ABSTRACT

An ice rink structure comprising: a sideboard securable to a ground surface and delimiting an inner rink area adjacent the sideboard for receiving water such that an ice surface is formed in the rink area by freezing of the water, the sideboard being hollow and having a sideboard cavity defined therein, the sideboard including a plurality of sideboard sections disposable side-by-side and securable together, wherein each sideboard sections comprises an inner sideboard panel facing towards the rink area and an outer sideboard panel spaced from the inner sideboard panel, away from the rink area, to form the sideboard cavity therebetween, wherein at least one of the inner sideboard panels comprises at least one sideboard opening proximal a bottom sideboard end for providing fluid communication between the inner rink area and the sideboard cavity to allow water from the inner rink area to enter the sideboard cavity.

20 Claims, 23 Drawing Sheets

(56) References Cited

U.S. PATENT DOCUMENTS

| | | | | |
|---|---|---|---|---|
| 3,986,342 | A | 10/1976 | MacCracken | |
| 4,022,437 | A * | 5/1977 | French | E01C 13/102 256/26 |
| 4,815,301 | A | 3/1989 | Deloughery | |
| 5,669,227 | A | 9/1997 | Morris | |
| 5,709,099 | A | 1/1998 | Blades | |
| 5,937,586 | A | 8/1999 | Scherba | |
| 6,230,451 | B1 | 5/2001 | Stoller | |
| 6,517,442 | B1 | 2/2003 | Post | |
| 8,905,853 | B2 | 12/2014 | Ruffino | |
| 9,821,216 | B2 | 11/2017 | Kurtin | |
| 9,833,689 | B2 | 12/2017 | Smith | |
| 9,889,369 | B2 | 2/2018 | Ruffino | |
| 11,712,617 | B2 | 8/2023 | Gastel | |
| 11,779,831 | B2 | 10/2023 | Gastel | |
| 2013/0277363 | A1 | 10/2013 | French | |
| 2017/0122640 | A1 | 5/2017 | Chen | |
| 2020/0040595 | A1 | 2/2020 | Cohen | |
| 2020/0179792 | A1 * | 6/2020 | Gastel | A63C 19/10 |

FOREIGN PATENT DOCUMENTS

| | | | |
|---|---|---|---|
| CA | 2777394 | A1 | 11/2013 |
| WO | 2012174668 | A1 | 12/2012 |

* cited by examiner

ICE RINK STRUCTURE AND METHOD FOR CONSTRUCTING AN ICE RINK USING THE SAME

CROSS-REFERENCE TO RELATED APPLICATIONS

This application claims priority under 35USC§ 119(e) of US provisional patent application No. 63/480,527 filed on Jan. 19, 2023, the specification of which is hereby incorporated by reference.

TECHNICAL FIELD

The technical field generally relates to ice rink structures and to methods for constructing ice rinks using ice rink structures.

BACKGROUND

Outdoor ice rink structures provide users with the ability to set up a rink such as an ice skating rink in an outdoor area such as a yard. The ice rink may be permanently installed in its designated location, or may be removably installed, to allow the ice rink to be assembled for use in winter and to be disassembled and stored away at the end of winter, for example.

An ice rink structure typically includes a sideboard which can be secured to a ground surface and forming a loop, and a liner, usually a flexible membrane, which extends across the loop to receive water. Water is then provided on the liner member and frozen to form an ice rink.

Prefabricated ice rink structures usually include a plurality of board panels that are removably securable together to form the sideboard and a plurality of anchor members for securing the board panels to the ground surface.

When water freezes, it tends to expand. This means that when the water is initially frozen within the sideboard, it can exert an outward pressure on the board panels which may tend to deform or even damage the board panels. Moreover, changes in temperature during winter may cause additional movement of the ice which can create further deformations and potentially cause further damage to the board panels.

It is also well known that ice rinks have evolved over the years and have been the object of various patent applications.

For example, known to the Applicant(s) is Canadian patent No. CA1,127,677, granted Jul. 13, 1982, in the name of LYONS, and relating to a "frame for a portable skating rink". This document describes a frame of a modular portable rink for holding a plastics sheet on the ground is basically of the type of a box-shaped, enclosed cross-sectional configuration composed of two generally identical structural shaped members disposed in a staggered relationship so that the abutment areas at the inside of the frame and at the outside thereof alternate to eliminate the need for special connectors between abutted parts of the frame. The only fasteners required are stakes driven at predetermined intervals through preformed holes in the respective elements. The invention simplifies the overall structure of the frame while enhancing its rigidity.

U.S. Pat. No. 9,821,216 B2, granted on Nov. 21, 2017, in the name of KURTIN et al., relates to a "modular barrier system". This document describes a portable ice rink includes a wall formed of multiple wall members linearly disposed adjacent to one another to form a piecewise continuous wall that encloses a desired area, and also includes a chain of links disposed on the outside of the wall members for reinforcement. The rink may further include a waterproof tarp extending underneath the wall members and folded upwards along the outer side of the wall, with its edge tied to the change of links. The tarp can contain water which then freezes to form a skating surface. Curved wall members are provided to form a rink with round corners. Each wall member is a discrete unit, made of molded plastic, and having a hollow interior which can be filled with water (or other ballast). Each wall member is designed with stiffening features to maintain the flatness of its inner surface after filling.

U.S. Pat. No. 8,905,853 B2, granted on Dec. 9, 2014, in the name of RUFFINO et al., relates to a "system and method for a portable ice skating rink". This document describes a portable ice skating rink comprising, a flexible rubber sheet having a first end and a second end wherein the first end is connected to the second end thereby forming a sidewall, wherein the sidewall is positioned on a horizontal surface to form the border of a closed geometric shape thereby defining a skating surface area, and a flexible, water-proof slip draped over and connected to the sidewalls, thereby forming a liner of a structure capable of containing a liquid inward of the sidewalls to create a skating surface.

U.S. Pat. No. 6,230,451 B1, granted on May 15, 2001, in the name of STOLLER, relates to an "ice skating rink structure". This document describes an ice skating rink structure comprising a plurality of boards and a plurality of brackets is provided. Each of the brackets has a U-shaped support for holding one or more of the boards and has at least one downward projection for insertion into the ground. The downward projection of the bracket is inserted into the ground and boards are placed within the U-shaped support such that the boards define the shape of an ice skating rink. A liner is placed inside of the ice skating rink and water is poured onto the liner and allowed to freeze and form an ice skating rink. By using boards with different heights, the present invention allows for the quick assembly of an ice skating rink on level or unlevel ground.

U.S. Pat. No. 3,986,342 A, granted on Oct. 19, 1976, in the name of McCRACKEN, relates to a "method of securing a perimeter fence around an ice rink without embedding into ground". This document describes a method of securing the dasher boards into the refrigerated ice slab is disclosed so that no attachment is required into the ground below and no damage is done to it. The ice is frozen as a continuous slab extending out for a foot or so behind the boards, the boards being supported on cantilever metal posts which provide bonding with the ice and provision for refrigerant piping underneath and behind the boards, and a cover box is provided which not only covers the bonding ice behind the boards but also acts as a cover for refrigerant header pipes instead of the usual expensive trench. Now for the first time unskilled personnel can completely assemble a refrigerated ice rink, make and maintain the ice, and then pack it away at the end of the season, allowing for the alternate recreational area use to begin.

Also known to the Applicant(s) are the following documents: WO 2012/174668 A1; US 2020/0040595 A1; US 2017/0122640 A1; US 2013/0277363 A1; U.S. Pat. Nos. 11,779,831 B2; 11,712,617 B2; 9,889,369 B2; 9,833,689 B2; 6,517,442 B1; 5,937,586 A; 5,709,099 A; 5,669,227 A; 4,815,301 A; 3,797,049 A, 3,012,596 A; CA 2,777,394 A1; CA 2,632,300 A1; and U.S. Pat. No. 3,986,342 A.

Despite these known improvements over the years, there is a need to continue innovating and finding better and/or different ways of assembling ice rink structure, in terms of facility to manufacture and to assemble, rigidity and longevity of the ice rink.

Thus, it would be particularly useful to be able to provide an improved ice rink which, by virtue of its design and components, would be able to overcome or at least minimize some of the known drawbacks associated with conventional ice rinks.

SUMMARY

According to one aspect, there is provided an ice rink structure comprising a sideboard securable to a ground surface and delimiting a rink area adjacent the sideboard for receiving water such that an ice surface is formed in the rink area by freezing of the water, the sideboard being hollow and having a sideboard cavity defined therein, the sideboard including a plurality of sideboard sections disposable side-by-side and securable together. Each sideboard sections comprises an inner sideboard panel facing towards the rink area and an outer sideboard panel spaced from the inner sideboard panel, away from the rink area, to form the sideboard cavity therebetween. At least one of the inner sideboard panels comprises at least one sideboard opening proximal a bottom sideboard end for providing fluid communication between the rink area and the sideboard cavity to allow water from the rink area to enter the sideboard cavity.

According to another aspect, there is also provided a kit for an ice rink structure. The kit comprises a sideboard securable to a ground surface and delimiting a rink area adjacent the sideboard for receiving water such that an ice surface is formed in the rink area by freezing of the water, the sideboard being hollow and having a sideboard cavity defined therein, the sideboard including a plurality of sideboard sections disposable side-by-side and securable together; and a liner member deployable across the rink area to receive water to be frozen, the liner member including an outer liner edge and a liner edge portion extending from the outer liner edge towards a center of the liner member, the liner edge portion being positionable such that it extends into the sideboard cavity. Each of the plurality of sideboard sections comprises an inner sideboard panel facing towards the rink area and an outer sideboard panel spaced from the inner sideboard panel, away from the rink area, to form the sideboard cavity therebetween. At least one of the inner sideboard panels comprises at least one sideboard opening proximal a bottom sideboard end for providing fluid communication between the rink area and the sideboard cavity to allow water from the rink area to enter the sideboard cavity and be received between the liner edge portion of the inner sideboard panel.

According to yet another aspect, there is also provided a method for constructing an ice rink using an ice rink structure. The method comprises positioning a plurality of outer sideboard panels of a plurality of sideboard sections end-to-end to delimit a rink area adjacent the plurality of sideboard sections; deploying a liner member across the rink area such that a liner edge portion of the liner member extends over the outer sideboard panels; and positioning a corresponding inner sideboard panel over each one of the outer sideboard panels such that the liner edge portion extends through a sideboard cavity formed between the inner and outer sideboard panels and such that the liner edge portion is held between the inner and outer sideboard panels.

According to an optional aspect, there is provided an ice skating rink structure comprising: a sideboard securable to a ground surface and delimiting a rink area adjacent the sideboard for receiving water such that an ice surface is formed in the rink area when the water is frozen, the sideboard being hollow and having a sideboard cavity defined therein, wherein the inner sideboard panel includes at least one sideboard opening proximal the lower inner panel end for providing fluid communication between the rink area and the sideboard cavity to allow water from the rink area to enter the sideboard cavity.

According to another optional aspect, there is also provided an ice skating rink structure comprising: a sideboard securable to a ground surface and delimiting a rink area adjacent the sideboard for receiving water such that an ice surface is formed in the rink area when the water is frozen, the sideboard being hollow and having a sideboard cavity defined therein, the sideboard including a plurality of sideboard sections disposable side-by-side and securable together, wherein each sideboard section includes an inner sideboard panel facing towards the rink area and an outer sideboard panel sideboard panel spaced from the inner sideboard panel, away from the rink area, to form the sideboard cavity therebetween, the inner sideboard panel and the outer sideboard panel being substantially identical to each other.

According to yet another optional aspect, there is also provided a kit for an ice skating rink structure, the kit comprising: a sideboard securable to a ground surface and delimiting a rink area adjacent the sideboard for receiving water such that an ice surface is formed in the rink area when the water is frozen, the sideboard being hollow and having a sideboard cavity defined therein; a liner member deployable across the rink area to receive water to be frozen, the liner member including an outer liner edge and a liner edge portion extending from the outer liner edge towards a center of the liner member, the liner edge portion being positionable such that it extends into the sideboard cavity, wherein the inner sideboard panel includes at least one sideboard opening proximal the lower inner panel end for providing fluid communication between the rink area and the sideboard cavity to allow water from the rink area to enter the sideboard cavity and be received between the liner edge portion of the inner sideboard panel.

According to yet another optional aspect, there is also provided a method for constructing an ice skating rink using an ice skating rink structure, the method comprising: positioning a plurality of outer sideboard panels of sideboard sections end-to-end to delimit a rink area adjacent the sideboard sections; deploying a liner member across the rink area such that a liner edge portion of the liner member extends over the outer sideboard panels; positioning a corresponding inner sideboard panel over each one of the outer sideboard panels such that the liner edge portion extends through a sideboard cavity formed between the inner and outer sideboard panels and such that the liner edge portion is held between the inner and outer sideboard panels.

According to yet another optional aspect, there is also provided an ice rink structure comprising a sideboard being securable to a ground surface and delimiting a rink area intended to receive water thereon, so as to form a resulting corresponding ice surface about the rink area, the sideboard being formed with a plurality of sideboard sections being disposable and connectable to one another, side-by-side, each sideboard section including a pair of inner and outer sideboard panels, said inner and outer sideboard panels being complementary to one another so as to provide each sideboard section with an inner sideboard cavity capable of receiving water, a bottom portion of at least one corresponding inner sideboard panel sideboard panel being provided with at least one sideboard opening, said at least one sideboard opening being in fluid communication between the rink area and the inner sideboard cavity so as to allow water to compensatively flow thereinbetween.

DETAILED DESCRIPTION

Figure 1:
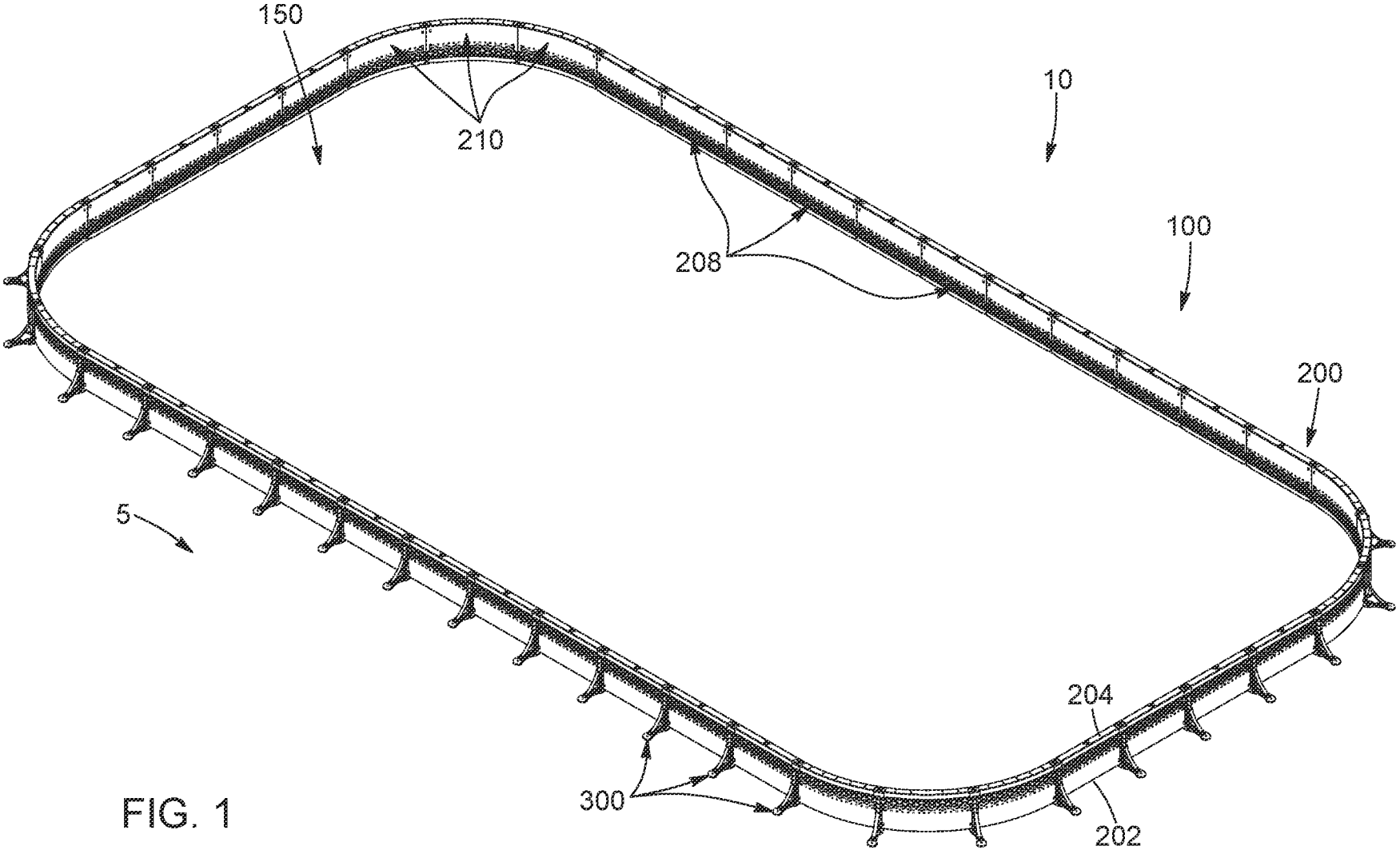
FIG. 1 is a perspective view of an ice rink structure for forming an ice rink, in accordance with one embodiment, with the liner member removed.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "top", "bottom", "forward", "rearward" "left", "right" and the like should, unless otherwise indicated, be taken in the context of the figures and correspond to the position and orientation in the ice rink structure and corresponding parts when being used. Positional descriptions should not be considered limiting.

Furthermore, in the context of the present description, it will be considered that all elongated objects will have an implicit "longitudinal axis" or "centerline", such as the longitudinal axis of a bore (ex. hole, opening, etc.), for example, or the centerline of a pin, fastener, etc., for example, and that expressions such as "connected" and "connectable", or "mounted" and "mountable", may be interchangeable, in that the present system also relates to a kit with corresponding components for assembling a resulting fully-assembled and fully-operational ice rink structure.

Moreover, components of the present system(s) and/or steps of the method(s) described herein could be modified, simplified, altered, omitted and/or interchanged, without departing from the scope of the present system, depending on the particular application(s) which the present system is intended for, and the desired end result(s), as briefly exemplified herein and as also apparent to a person skilled in the art.

In addition, although the optional embodiments of the present system as illustrated in the accompanying drawings comprise various components, and although the optional embodiments of the present ice rink structure and corresponding portion(s)/part(s)/component(s) as shown consist of certain geometrical configurations, as explained and illustrated herein, not all of these components and geometries are essential to the system and thus should not be taken in their restrictive sense, i.e. should not be taken so as to limit the scope of the present system. It is to be understood, as also apparent to a person skilled in the art, that other suitable components and cooperation there in between, as well as other suitable geometrical configurations may be used for the present ice rink structure and corresponding portion(s)/part(s)/component(s) according to the present system, as will be briefly explained herein and as can be easily inferred here from by a person skilled in the art, without departing from the scope of the present system.

Referring to FIG. 1, there is shown an ice rink structure 100 for forming an ice rink 10, in accordance with one embodiment. The ice rink structure 100 is disposed on a ground surface 5 and includes a sideboard 200 which delimits a rink area 150 adjacent the sideboard 200. Specifically, in the illustrated embodiment, the sideboard 200 is disposed in a loop and the rink area 150 is formed within the loop. Alternatively, the sideboard 200 could be positioned opposite another sideboard 200 and the rink area 150 could be defined therebetween to form an icy path or skateway, or the sideboard 200 could be configured in accordance with any other suitable configuration.

It will be understood that the embodiments of the ice rink structure described herein are merely provided as examples and that various alternative configurations may be considered. For example, the ice rink 10 that is formed by the ice rink structure 100 can be used as an ice-skating rink, but can also be used for any other activities that are usually performed on an ice rink, including but not limited to hockey, broom ball, curling, etc.

In the illustrated embodiment, the sideboard 200 extends between a bottom sideboard end 202 which can be positioned against the ground surface 5 and a top sideboard end 204 opposite the bottom sideboard end 202. For example, the ground surface 5 could include soil such as soil found in a yard or any other similar location, and the ice rink structure 100 could be configured to dig into the soil to thereby prevent movement of the ice rink 10 once installed in this location. Specifically, in the illustrated embodiment, the ice rink structure 100 includes a plurality of anchor members 300 which are securable to the sideboard 200 such that they extend outwardly from the sideboard 200. The anchor members 300 are configured to engage the ground surface 5 to thereby secure the sideboard 200 to the ground surface. Alternatively, the ground surface 5 could include concrete, pavement or any other type of ground surface, with the anchor members 300 being configured for engaging the ground surface.

In the illustrated embodiment, the sideboard 200 extends generally vertically, or substantially perpendicular to the ground surface 5. Alternatively, the sideboard 200 could be angled slightly outwardly or inwardly, or have any other suitable configuration or orientation.

In the illustrated embodiment, the sideboard 200 includes a plurality of sideboard sections 208, 210 that are connected to each other end-to-end to form the loop configuration of the sideboard 200. This may facilitate the transportation and assembly of the sideboard 200.

Figure 2:
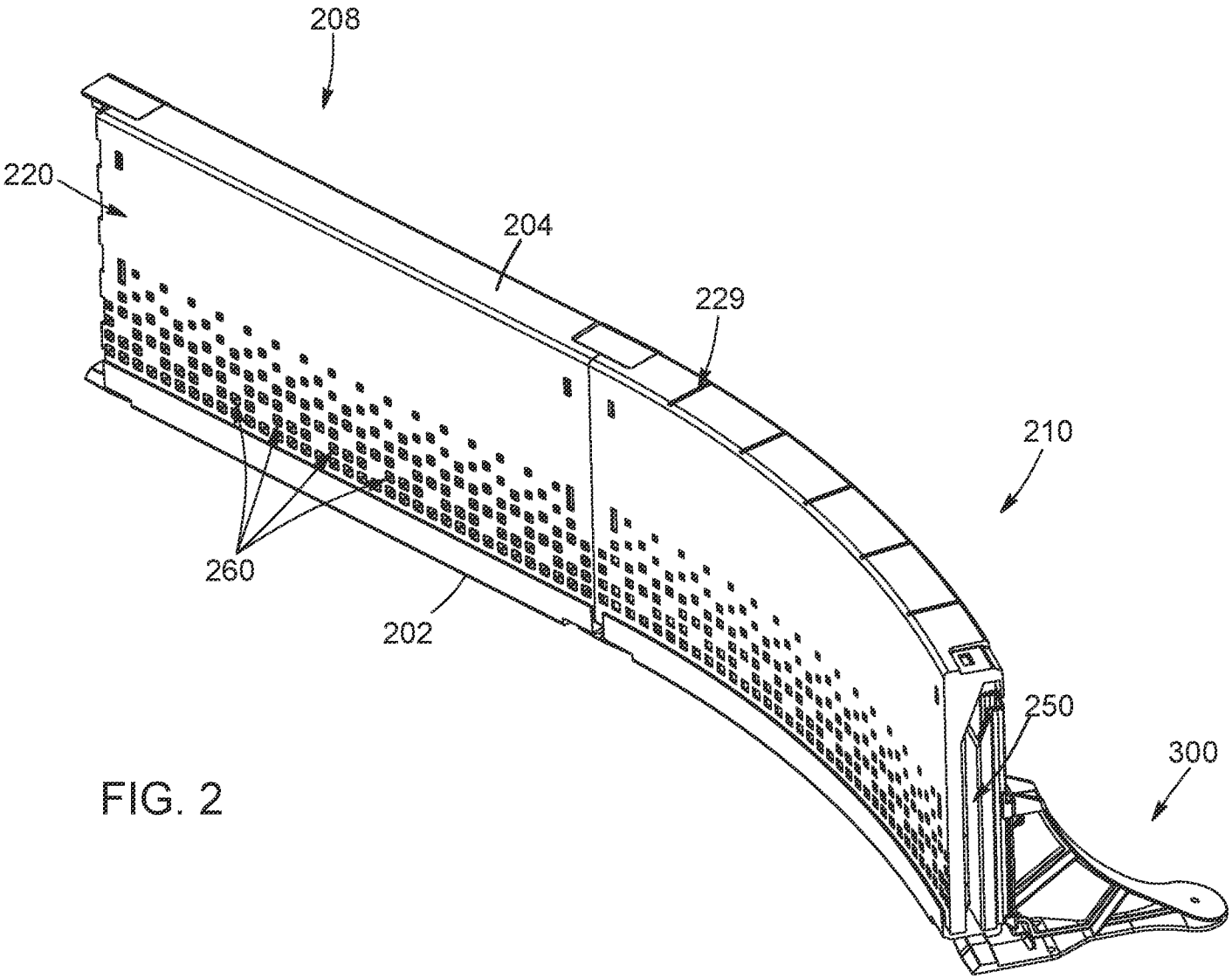
FIG. 2 is a rink-side perspective view of a portion of a sideboard for the ice rink structure illustrated in FIG. 1.
Figure 3:
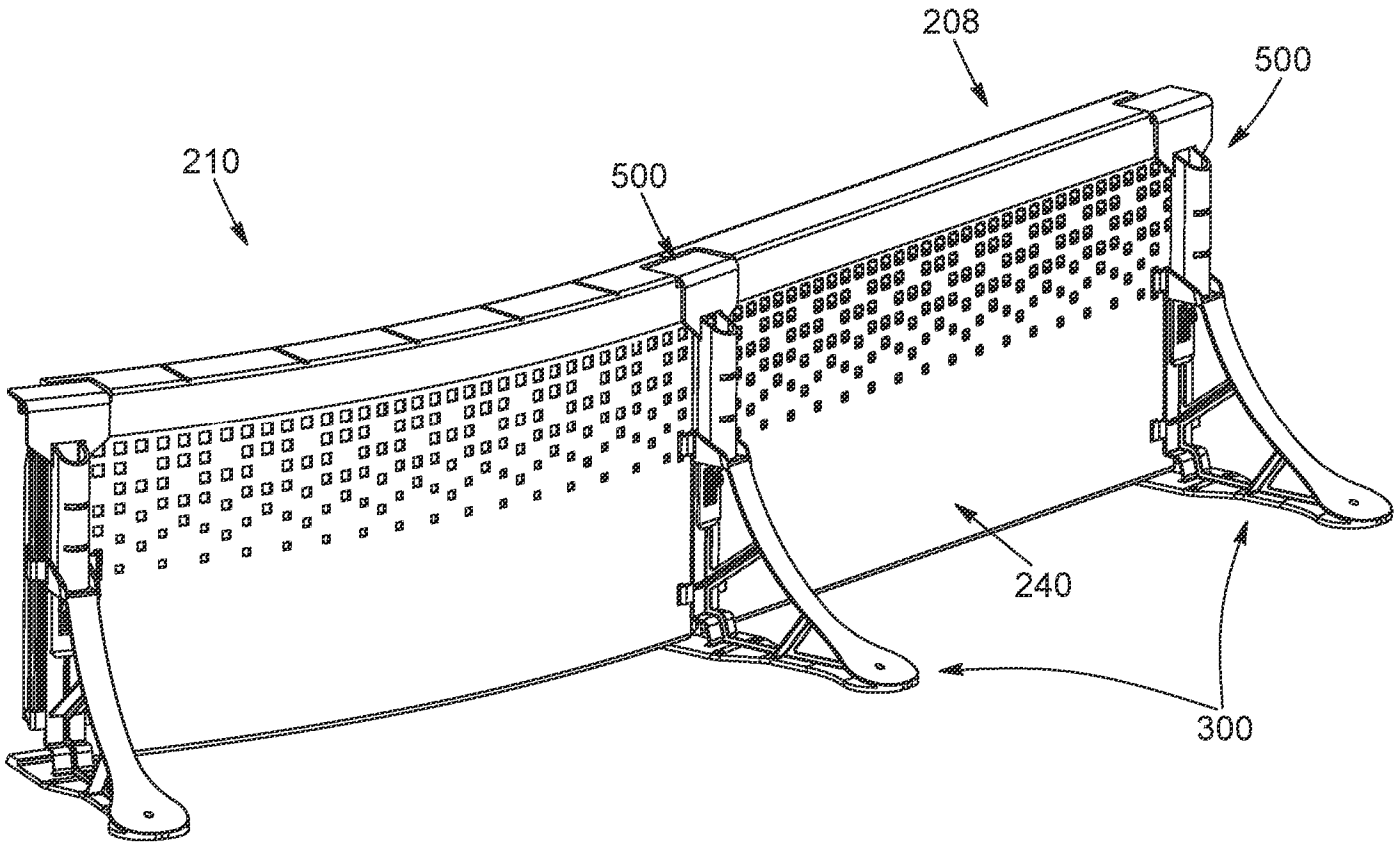
FIG. 3 is an exterior-side perspective view of a portion of a sideboard for the ice rink structure illustrated in FIG. 1.

Still in the illustrated embodiment, the ice rink 10 is substantially shaped as a rectangle with rounded corners. Specifically, and as best shown in FIGS. 2 and 3, the sideboard sections 208, 210 include a plurality of straight sideboard sections 208 which are used to form straight sides of the ice rink 10 and a plurality of curved sideboard sections 210 which are used to form the rounded corners of the ice rink 10. Alternatively, the ice rink 10 could have any other suitable shape. For example, the ice rink could be substantially circular or oval-shaped. In this case, the sideboard sections may not include any straight sideboard sections 208 and may only include curved sideboard sections 210.

Figure 8:
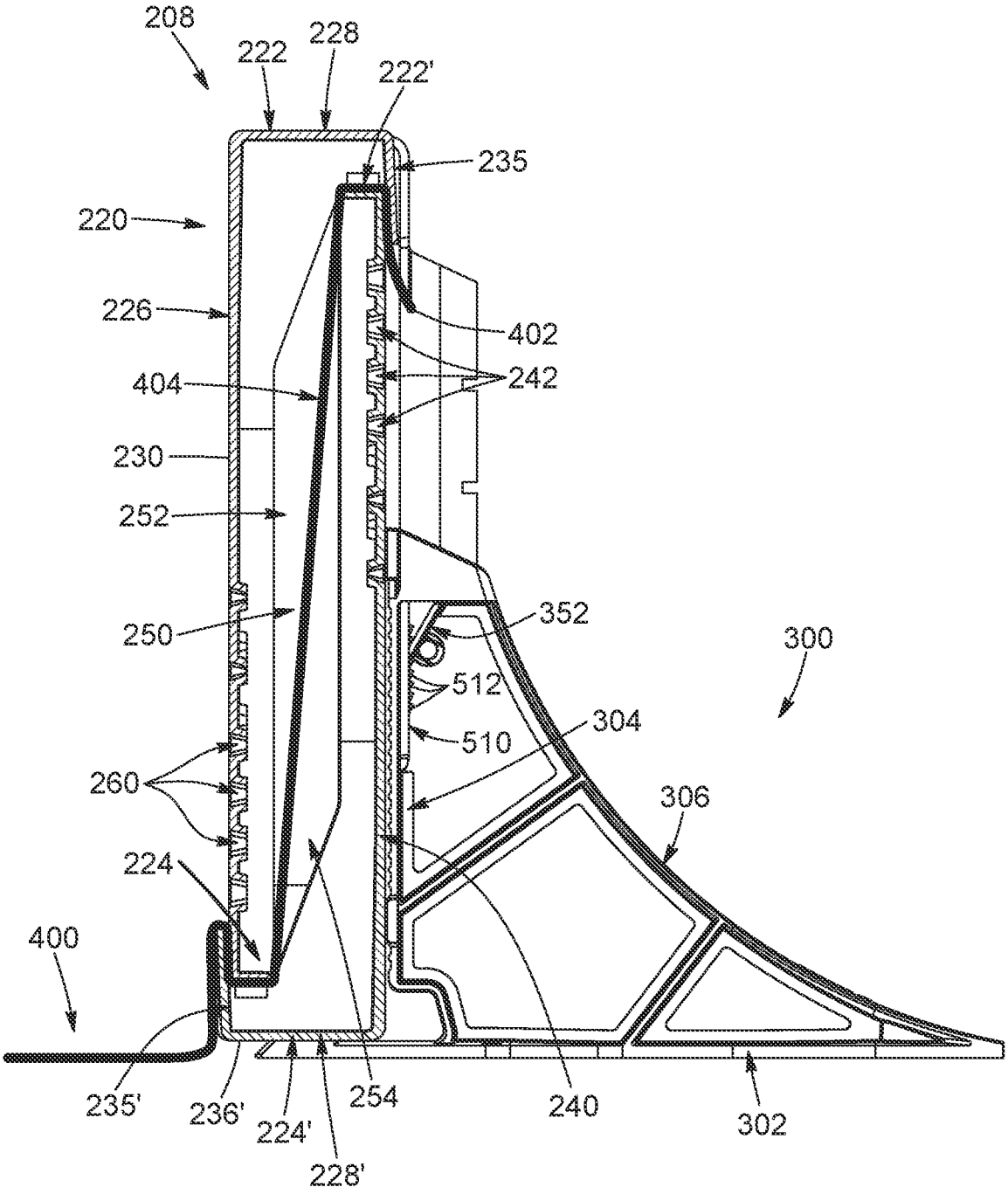
FIG. 8 is a cross-section of the straight sideboard section for the ice rink structure illustrated in FIG. 1.

The ice rink structure 100 further includes a liner member 400, shown in FIG. 8, which extends across the rink area 150. Specifically, the liner member 400 is configured to cover the ground surface 5 across the entire area within the loop formed by the sideboard 200 and is adapted for receiving water and containing the water within the rink area 150. Specifically, in the illustrated embodiment, the liner member 400 includes a flexible membrane which is substantially waterproof to contain the water to prevent the water from seeping through on or into the ground surface below the liner member 400.

When the ambient temperature falls below the water's freezing temperature, the water received on the liner member 400 freezes and forms an ice layer over the liner member 400. In one embodiment, a sufficient amount of water is provided in a single instance to form an ice layer having a desired thickness and/or desired properties. Alternatively, water could be provided in multiple successive instances over a period of time. For example, an amount of water could be provided and could at least partially freeze on the liner member 400 on a certain day. Additional water could then be provided at another time, for example on the next day, on top of the at least partially frozen water and be allowed to also at least partially freeze. Other amounts of water could be similarly added at other times and be similarly frozen until the water is substantially entirely frozen and the ice layer is entirely formed in the rink area 150.

It is known that water tends to expand as it freezes. Specifically, when the water received on the liner member 400 expands, it would tend to expand outwardly and therefore apply pressure on the sideboard. To relieve this pressure and substantially prevent deformation of the sideboard 200, the sideboard 200 is hollow and includes a sideboard cavity 250 and a plurality of sideboard openings 260 through which the water may enter the sideboard cavity 250, as will be further detailed above.

As shown in FIGS. 2 and 3, each sideboard section 208, 210 includes an inner sideboard panel 220 facing towards the rink area 150 and an outer sideboard panel 240 spaced outwardly from the inner sideboard panel 220 to define the sideboard cavity 250 between the inner and outer sideboard panels 220, 240.

In the illustrated embodiment, the liner member 400 is secured to the sideboard 200 such that the inner sideboard panel 220 is adjacent to the rink area 150, i.e. such that the sideboard 200 is not covered by the liner member 400, and the sideboard openings 260 are defined in the inner sideboard panel 220 near the bottom sideboard end 202.

More specifically, the liner member 400 includes an outer liner edge 402 and an outer liner edge portion 404 which extends inwardly from the outer liner edge 402 and peripherally around the liner member 400. The outer liner edge portion 404 is received in the sideboard cavity 250 and extends therethrough substantially from the bottom sideboard end 202 to the top sideboard end 204. Specifically, the outer liner edge portion 404 is received between the inner and outer sideboard panels 220, 240 and is held therebetween. In this configuration, the outer liner edge portion 404 therefore divides the sideboard cavity 250 into an inner panel facing portion 252 located between the inner sideboard panel and the outer liner edge portion 404, and an outer panel facing portion 254 located between the outer sideboard panel 240 and the outer liner edge portion 404. The inner panel facing portion 252 is in fluid communication with the rink area 150 through the sideboard openings 260, while the outer panel facing portion 254 is isolated from the rink area by the outer liner edge portion 404 of the liner member 400. When water is provided in the rink area 150 on the liner member 400, the water will enter the inner panel facing portion 252 through the sideboard openings 260. It will be understood that as water is poured in the rink area 150, since the sideboard openings 260 are substantially close to the ground surface, the level of the water in the sideboard cavity 250 will correspond to the level of water in the rink area 150. When the water freezes and expands, the water will therefore exert little to no pressure on the inner sideboard panel 220, and will instead exert outward pressure on the outer liner edge portion 404 and on the outer sideboard panel 240. This therefore substantially prevents the inner sideboard panel 220 from deforming due to the expansion of water as it freezes.

In the illustrated embodiment, the inner and outer sideboard panels 220, 240 of each straight sideboard section 208 are substantially identical to each other. Specifically, the outer sideboard panel 240 is positioned relative to the inner sideboard panel 220 so as to form the vertically inverted (i.e., upside-down) mirror image of the inner sideboard panel 220.

It will be understood that the inner and outer sideboard panels 220, 240 being substantially identical may facilitate the assembly of the sideboard by the user by eliminating the need for the user to identify separate inner and outer sideboard panels prior to assembly to form the sideboard section 208. This may further facilitate the packaging and/or shipping of the sideboard by eliminating the need to provide a matching number of inner and outer sideboard panels 220, 240 for each ice ring structure. This may also reduce the cost and complexity associated with the manufacturing of the sideboard by eliminating the need to create and use different equipments such as molds, toolings or the like to produce two different sideboard panels. In another embodiment, the inner and outer sideboard panels 220, 240 could instead be different from each other.

Figure 4B:
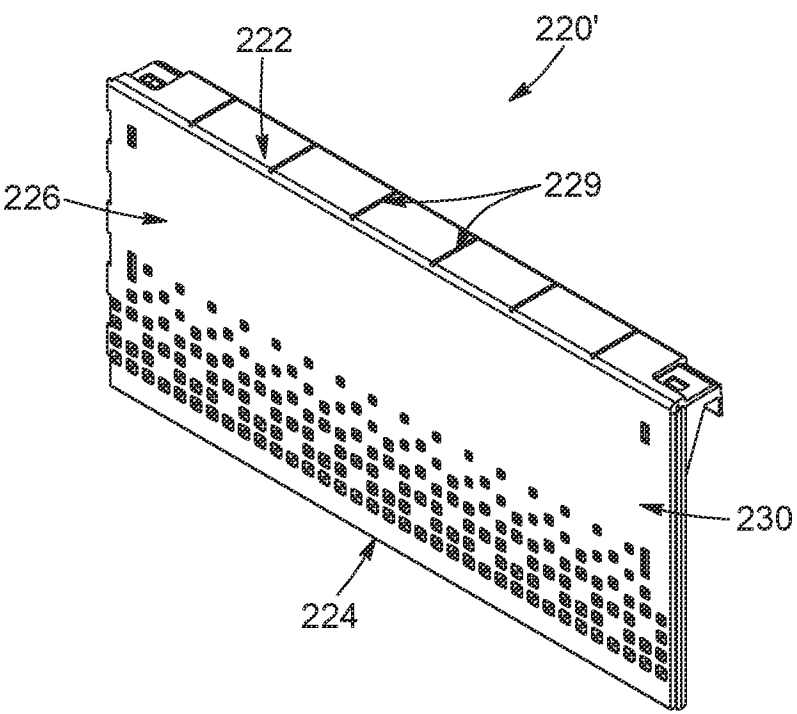
FIG. 4B is a front perspective view of an inner sideboard panel for the straight sideboard section of the ice rink structure illustrated in FIG. 2, in accordance with another embodiment.
Figure 4A:
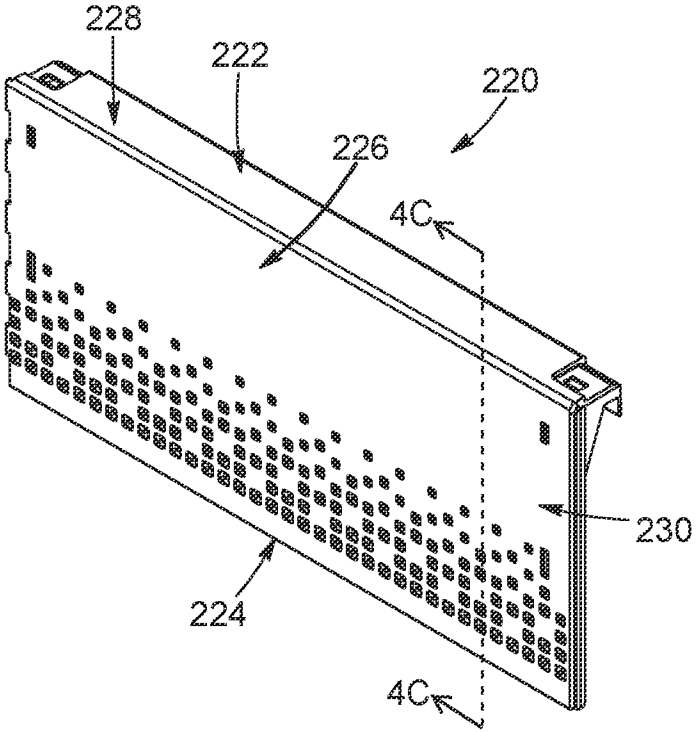
FIG. 4A is a front perspective view of an inner sideboard panel for the straight sideboard section of the ice rink structure illustrated in FIG. 2, in accordance with one embodiment.
Figure 4C:
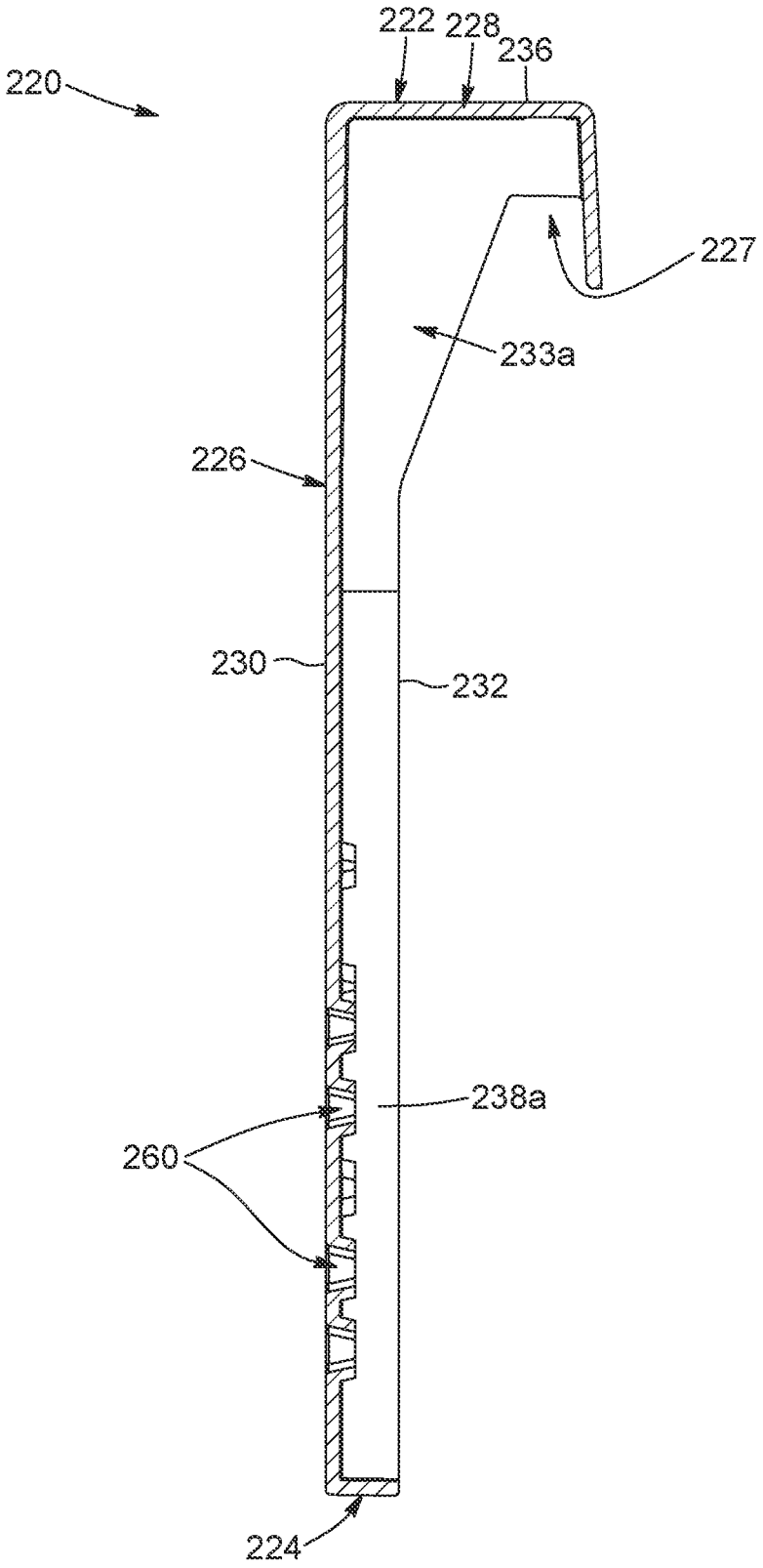
FIG. 4C is a cross-section view of the inner sideboard panel for the straight sideboard section of the ice rink structure illustrated in FIG. 4A.

Referring specifically to FIGS. 4A and 4C, the inner sideboard panel 220 of the straight sideboard section 208 extends between an upper panel end 222 and a lower panel end 224 and includes a planar portion 226 extending from the lower panel end 224 towards the upper panel end 222 and a rim portion 228 located at the upper panel end 222. In the illustrated embodiment, the inner sideboard panel 220 has a substantially L-shaped profile such that the rim portion 228 extends generally perpendicularly to the planar portion 226. More specifically, the planar portion 226 has an exterior face 230 and an interior face 232 opposite the exterior face 230, and the rim portion 228 extends away from the exterior face 230. When the inner sideboard panel 220 is connected to the outer sideboard panel 240 to form the straight sideboard section 208, the exterior face 230 faces towards the rink area 150 and the interior face 232 faces towards the sideboard cavity 250.

Referring to FIG. 4B, the inner sideboard panel 220' of the curved sideboard sections 210 is slightly different from the inner sideboard panel 220 of the straight sideboard sections 208. In particular, the inner sideboard panels 220' of the curved sideboard sections 210 can further comprise ridges 229 on the rim portion 228. The ridges 229 are substantially shallow on the rim portion 228 and extending perpendicularly from the planar portion 226. The ridges are substantially evenly distributed along the rim portion 228. In the embodiment shown, the inner sideboard panel 220' comprises six (6) ridges substantially evenly distributed along the rim portion 228. Alternatively, the inner sideboard panel 220' may comprise a different number of ridges along the rim portion 228, and the ridges can be disposed according to any other suitable orientation and pattern. The ridges 229 allows the inner sideboard panel 220' to be slightly bended to form the curved sideboard sections 210 while preventing the inner sideboard panel 220' to be broken.

Similarly, the outer sideboard panels 240' of the curved sideboard sections 210 can also comprise ridges 229 on the rim portion 228 to allow the outer sideboard panel 240' to be slightly bended to form the curved sideboard sections 210. In the illustrated embodiment, the inner and outer sideboard panels 220', 240' of the curved sideboard sections 210 are different from each other. Specifically, the inner sideboard panel 220' of the curved sideboard sections 210 may be curved according to a smaller radius of curvature than the outer sideboard panel 240' of the curved sideboard sections 210.

Figure 5:
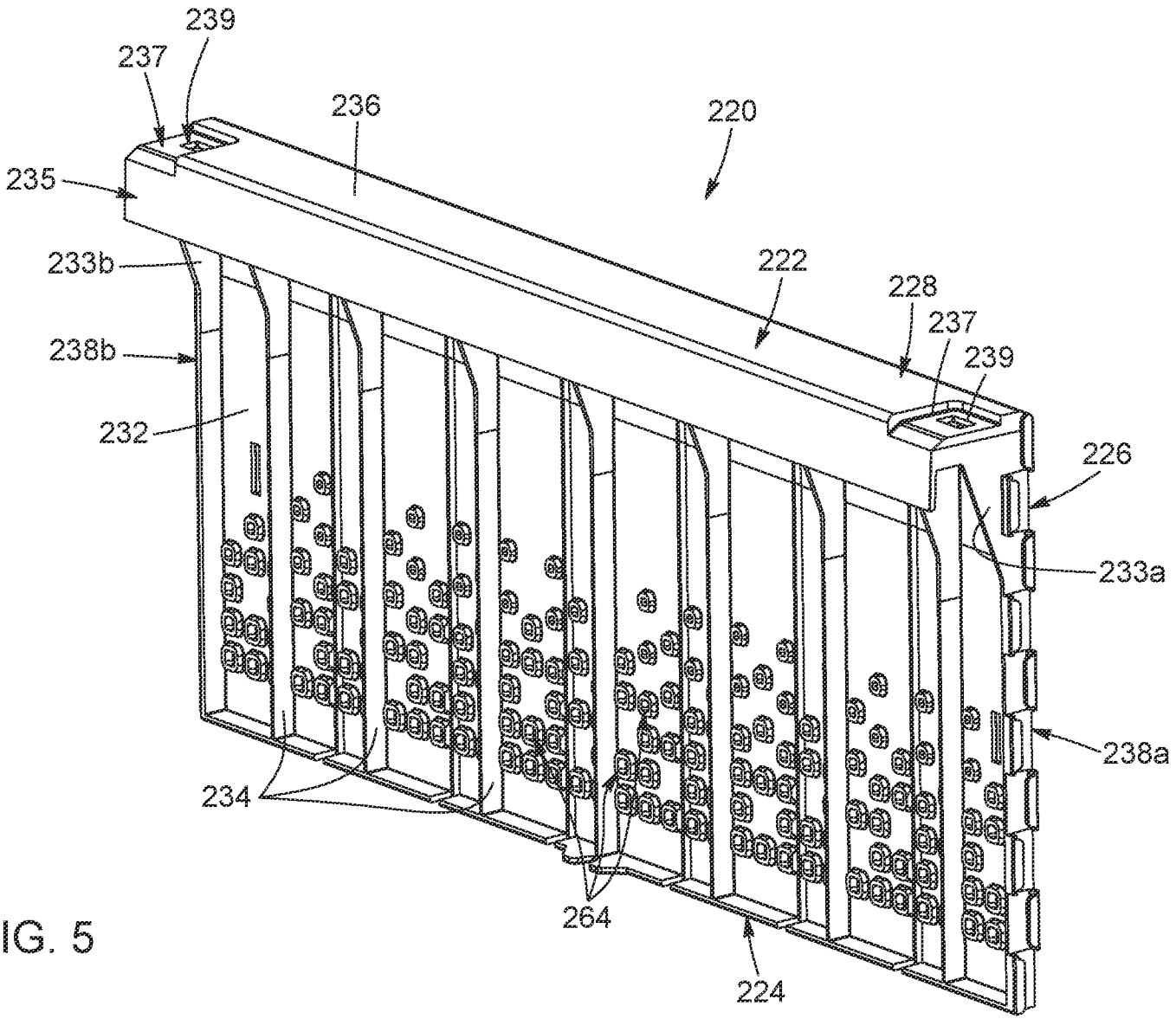
FIG. 5 is a back perspective view of the inner sideboard panel for the straight sideboard section of the ice rink structure illustrated in FIG. 4A.

Referring to FIG. 5, the inner sideboard panel 220 further includes a plurality of rib members 234 which extend substantially vertically between the upper and lower panel ends 222, 224 and which are spaced from each other in a widthwise direction. The rib members 234 may contribute to rigidifying the planar portion 226. Alternatively, the rib members 234 may be disposed according to any other suitable orientation and pattern, or the inner sideboard panel 220 may not include any rib members 234.

In the illustrated embodiment, the inner sideboard panel 220 further includes a pair of inner sideboard triangular panels 233*a*, 233*b* extending between the planar portion 226 and the rim portion 228 and located at opposite lateral ends 238*a*, 238*b* of the inner sideboard panel 220.

In the illustrated embodiment, the rim portion 228 of the inner sideboard panel 220 includes a hook-shaped end portion 235, defining a receiving recess 227 of the rim portion.

Figures 6, 6A, 6B:
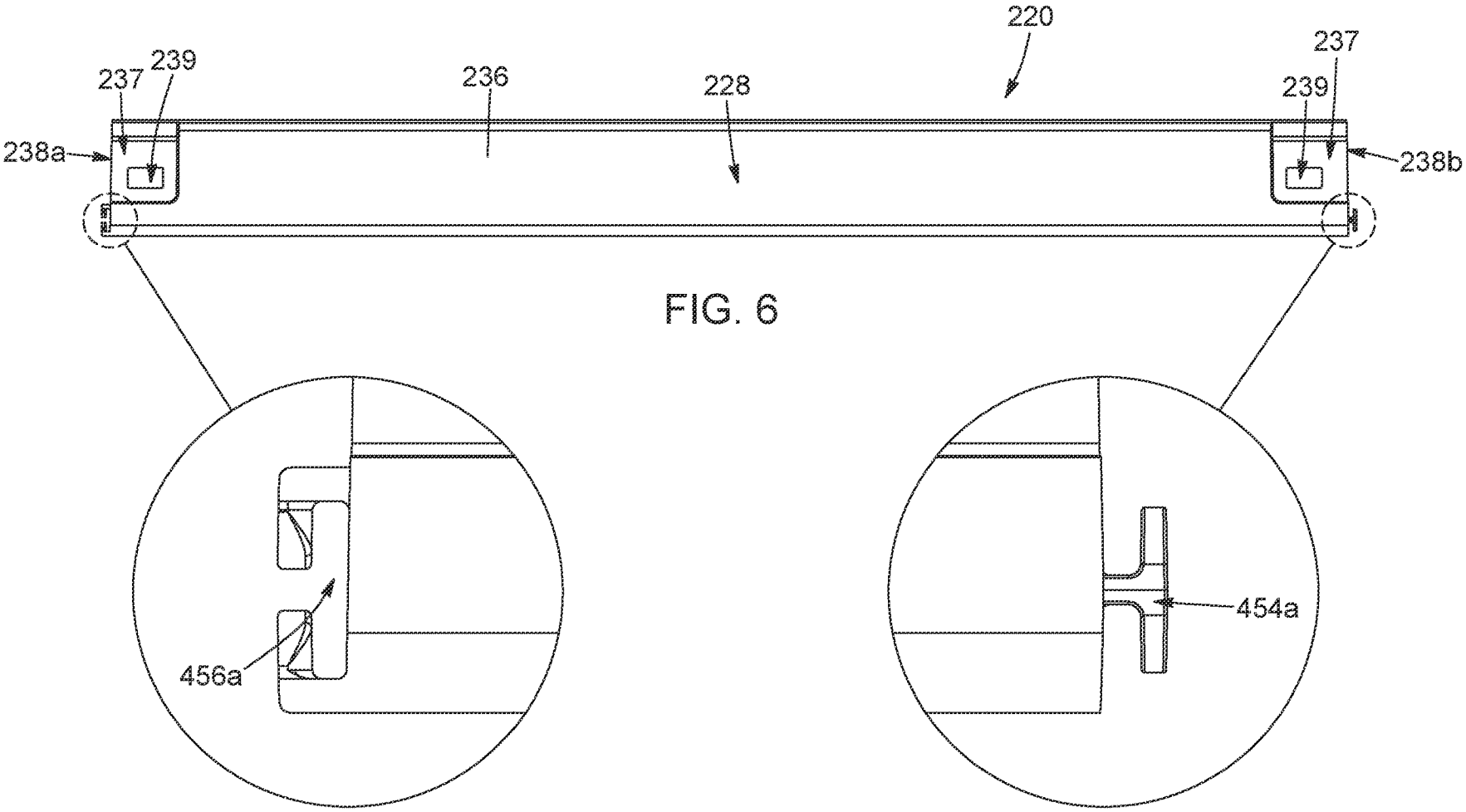
FIG. 6 is a top elevation view of the inner sideboard panel for the straight sideboard section of the ice rink structure illustrated in FIG. 4A.
FIGS. 6A and 6B are enlarged view of left and right extremities of the portion of a straight sideboard section of FIG. 6, respectively.

Referring to FIG. 6, the rim portion 228 also includes a top face 236, left and right connector recesses 237 defined in the top face 236 at the opposite lateral ends 238*a*, 238*b* of the inner sideboard panel 220, and connector-receiving openings 239 defined in the connector recesses 237. The connector recesses 237 and the connector-receiving openings 239 are configured to cooperate with connector recesses 237 and connector-receiving openings 239 of adjacent sideboard sections 208, 210 to connect the sideboard sections 208, 210 together, as will be explained further below.

Figure 7:
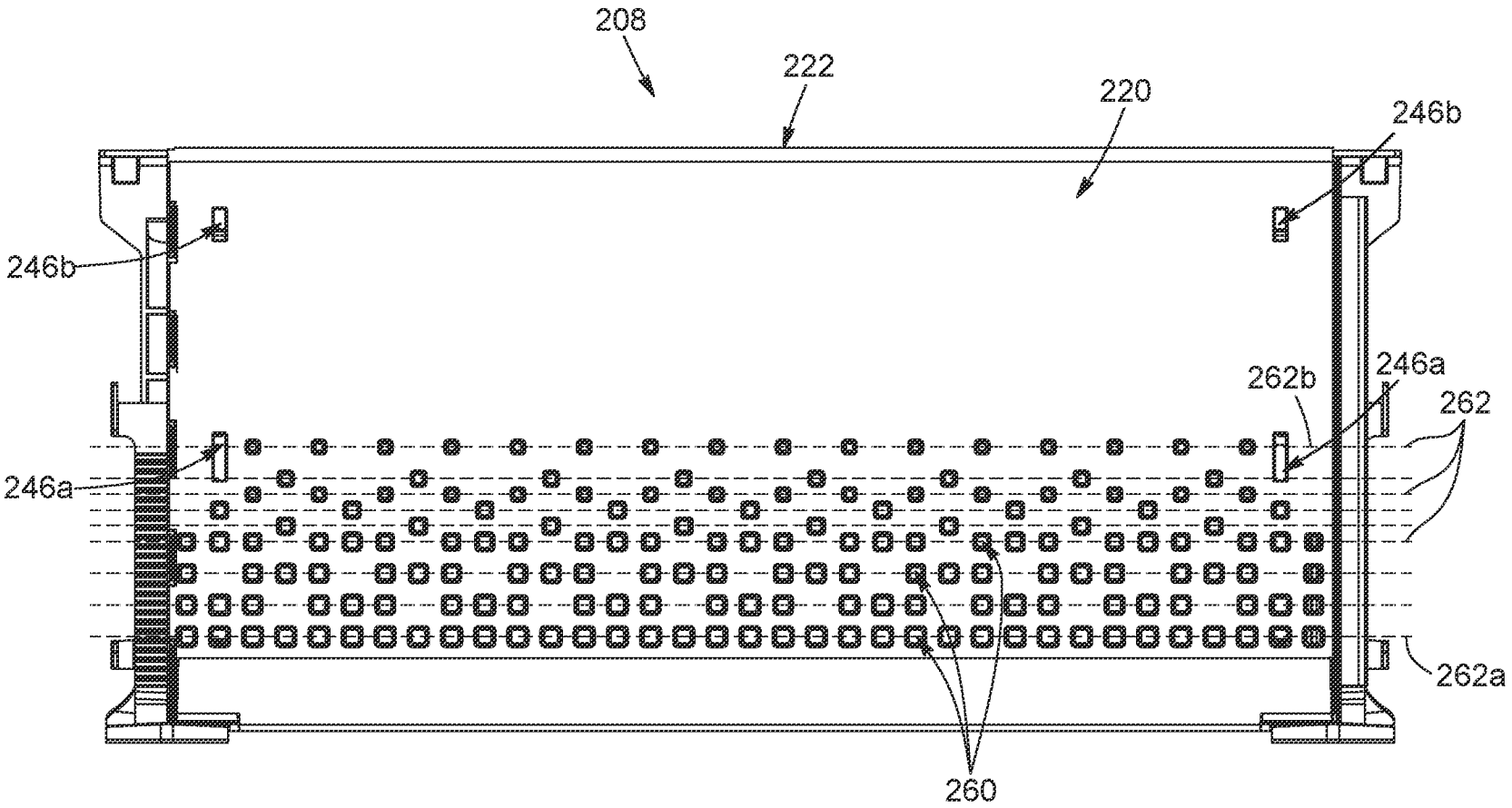
FIG. 7 is a front elevation view of the portion of a straight sideboard section for the ice rink structure illustrated in FIG. 1.

Referring to FIG. 7, the planar portion 226 of the inner sideboard panel 220 can further include a pair of upper anchor-receiving openings 246*b* and a pair of lower anchor-receiving openings 246*a*, spaced apart from each other, each of the pair of upper anchor-receiving openings 246*b* and of lower anchor-receiving openings 246*a* being located proximal to one of the opposite lateral ends 238*a*, 238*b* of the inner sideboard panel 220. The pair of upper anchor-receiving openings 246*b* and the pair of lower anchor-receiving openings 246*a* are configured to cooperate with the pair of upper anchor-receiving openings 246*b* and the pair of lower anchor-receiving openings 246*a* of adjacent sideboard sections 208, 210 to connect the sideboard sections 208, 210 together, as will be explained further below.

Alternatively, the anchor member 300 could include only one pair of anchor-receiving openings, more than two pair of anchor-receiving openings or may not include any pair of anchor-receiving openings.

Still referring to FIG. 7, the sideboard openings 260 are defined in the planar portion 226, proximal to the lower panel end 224, and extend between the exterior face 230 and the interior face 232, as best shown in FIGS. 4C and 5. The sideboard openings 260 are disposed in a plurality of opening rows 262, which extend substantially in a widthwise direction on the inner sideboard panel 220. Specifically, the opening rows 262 are oriented so as to be substantially parallel to the ground surface when the sideboard 200 is secured to the ground surface.

Still in the illustrated embodiment, all the sideboard openings 260 have substantially the same shape. More specifically, all the sideboard openings 260 are substantially square-shaped. Alternatively, the sideboard openings 260 may have any other suitable shape. In yet another embodiment, the sideboard openings 260 may not all have the same shape.

Still in the illustrated embodiment, all the sideboard openings 260 do not have the same size. Specifically, each sideboard opening 260 has a certain side length, and the side length of the openings 260 decrease from a bottom opening row 262*a* located towards the lower panel end 224 to a top opening row 262*b* located towards the upper panel end 222. Alternatively, the sideboard openings 260 could all have the same size. In yet another embodiment, the sideboard openings 260 in each row 262 may not have the same size as other openings 260 in the same row 262.

The sideboard openings 260 are also located at varying widthwise spacings from each other. In the illustrated embodiment, in some opening rows 262, the spacing between all consecutive sideboard openings 260 is the same while in other openings rows 262, the spacing between consecutive sideboard openings 260 may vary along the row 262.

In the illustrated embodiment, the sideboard openings 260 are further substantially tapered. Specifically, each sideboard opening 260 tapers as it extends from the exterior face 230 towards the interior face 232, as shown in FIG. 4C. Alternatively, the sideboard openings 260 may instead taper as they extend from the interior face 232 towards the exterior face 230. In another embodiment, the sideboard openings 260 may be straight instead of tapered. In yet another embodiment, some of the openings 260 may be tapered and some of the openings 260 may be straight.

Still in the illustrated embodiment, each sideboard opening 260 is surrounded by a projecting rim 264, shown in FIG. 5, which extends away from the interior face 232. Alternatively, the inner sideboard panel 220 may not include any projecting rim.

It will be understood that the configuration and positioning of the sideboard openings 260 on the inner sideboard panel 220 shown and described herein is merely provided as an example and that the sideboard openings 260 could be configured and positioned according to any other suitable configuration.

As explained above, and according to a possible embodiment, the outer sideboard panel 240 is substantially similar to the inner sideboard panel 220, but vertically inverted. Specifically, the outer sideboard panel 240 includes an upper panel end 222' which is similar to the lower panel end 224 of the inner sideboard panel 220, and a lower panel end 224' which is similar to the upper panel end 222 of the inner sideboard panel 220. More specifically, the lower panel end 224' of the outer sideboard panel 240 defines a base portion 228' which is substantially similar to the rim portion 228 of the inner sideboard panel 220, and which includes a hook-shaped end portion 235' similar to the hook-shaped end portion 235 of the inner sideboard panel 220. The hook-shaped end portion 235' also defines a receiving recess 227' of the base portion 228'. The base portion 228' also includes receiving recesses 237', best shown in FIG. 16, defined in a bottom face 236' of the base portion 228' at opposite lateral ends 239*a*, 239*b* of the outer sideboard panel 240, similar to the left and right connector recesses 237. The outer sideboard panel 240 also includes a pair of outer sideboard triangular panels 233' located at the opposite lateral ends 239*a*, 239*b* of the outer sideboard panel 240, similar to the inner sideboard triangular panels 233*a*, 233*b*. The outer sideboard panel 240 also includes a pair of lower anchor-receiving openings 246*b'* which is similar to the pair of upper anchor-receiving openings 246*b* of the inner sideboard panel 220, and a pair of upper anchor-receiving openings 246*a'* which is similar to the pair of lower anchor-receiving openings 246*a* of the inner sideboard panel 220.

Figure 16:
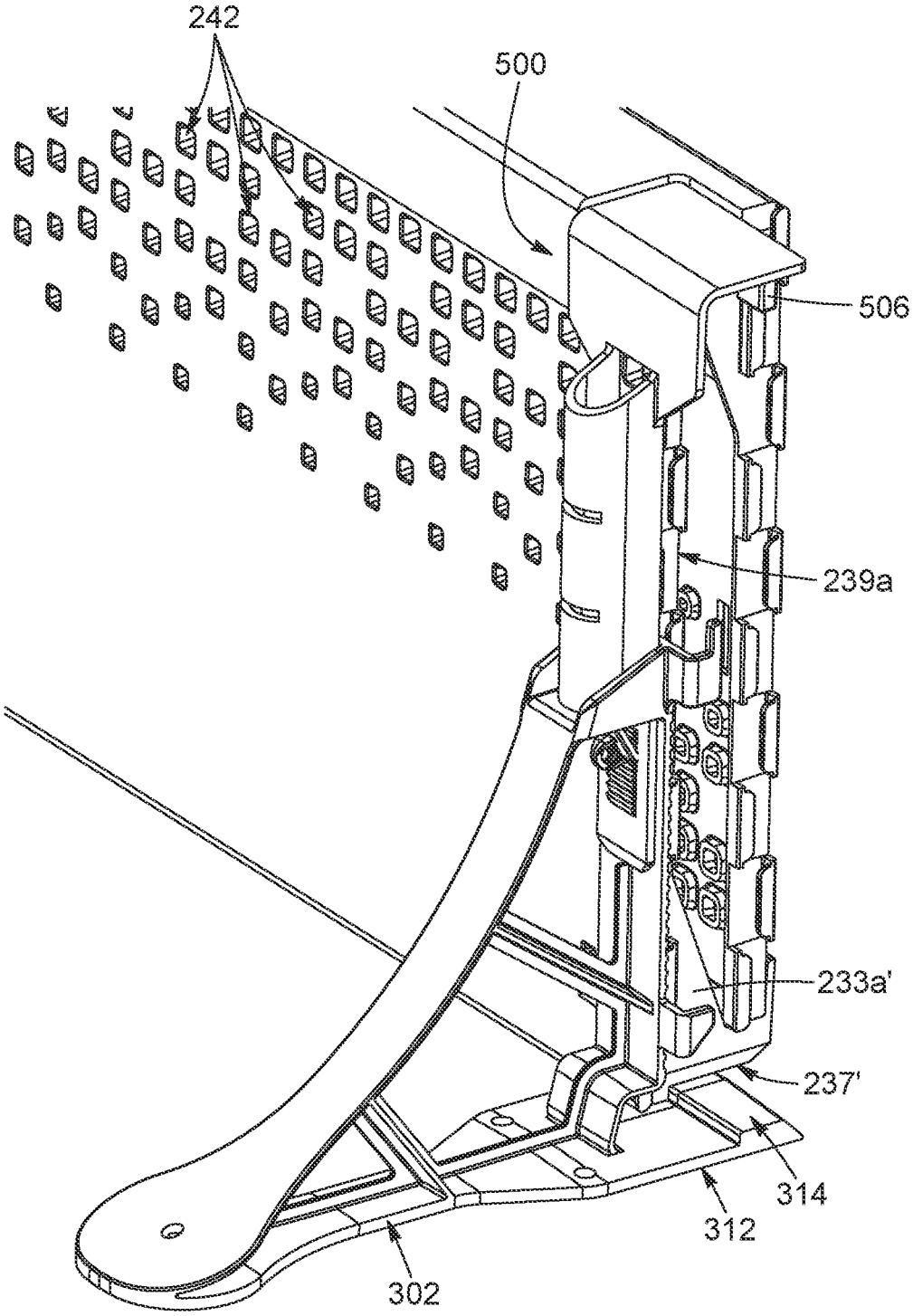
FIG. 16 is a portion of a sideboard and an anchor member for the ice rink structure illustrated in FIG. 1, showing the anchor member engaging a straight sideboard section.

In the illustrated embodiment, the outer sideboard panel 240 further includes outer openings 242 defined near the upper panel end 222' of the outer sideboard panel 240. The openings 242 provide communication between the outer panel facing portion 254 of the sideboard cavity 250 and an exterior of the sideboard section 208, as shown in FIG. 16. As explained above, for ease of manufacturing and/or assembly, the inner and outer sideboard panels 220, 240 are substantially identical to each other. The outer openings 242 therefore mirror the sideboard openings 260 defined in the inner sideboard panel 220. Alternatively, the outer sideboard panel 240 may not include any outer openings 242.

As best shown in FIG. 8, when the inner and outer sideboard panels 220, 240 are assembled together to form the corresponding sideboard section 208, the hook-shaped end portion 235 of the inner sideboard panel 220 engages the upper panel end 222' of the outer sideboard panel 240 such that the upper panel end 222' of the outer sideboard panel is nested in the receiving recess 227 of the inner sideboard panel 220, and the hook-shaped end portion 235' of the outer sideboard panel 240 engages the lower panel end 224 of the inner sideboard panel 220 such that the lower panel end 224 of the inner sideboard panel is nested in the receiving recess 227 of the outer sideboard panel 240. Furthermore, when the outer liner edge portion 404 of the liner member 400 extends between within the sideboard cavity 250, the outer liner edge portion 404 extends between the hook-shaped end portion 235 of the inner sideboard panel 220 and the upper panel end 222' of the outer sideboard panel 240, and between the hook-shaped end portion 235' of the outer sideboard panel 240 and the lower panel end 224 of the inner sideboard panel 220. The outer liner edge portion 404 could be held therebetween solely by friction, or could be secured to the inner sideboard panel 220 and/or the outer sideboard panel 240 using one or more fasteners or any other suitable securing means.

Figure 9B:
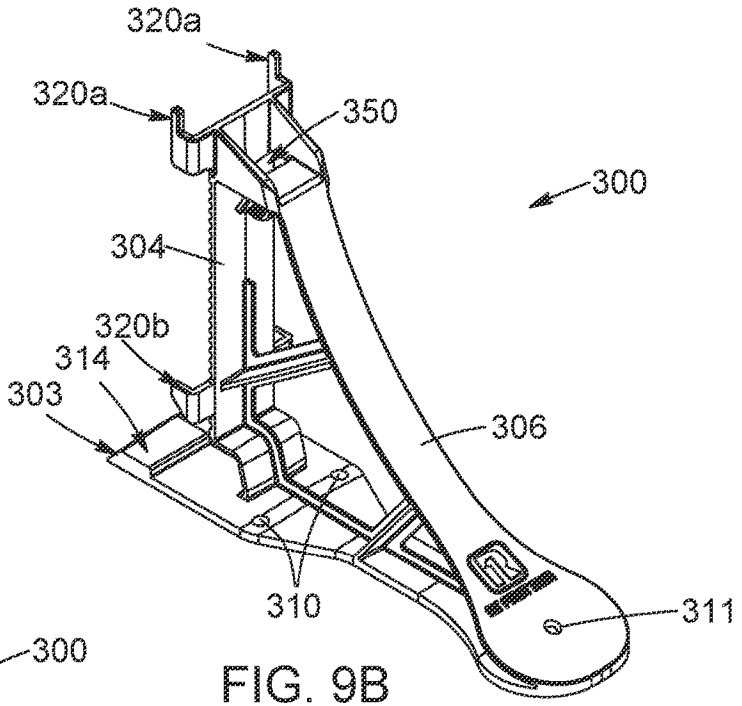
FIGS. 9A, 9B and 9C are perspectives views and side elevation view of an anchor member securable to the sideboard section for the ice rink structure illustrated in FIG. 1.
Figure 9C:
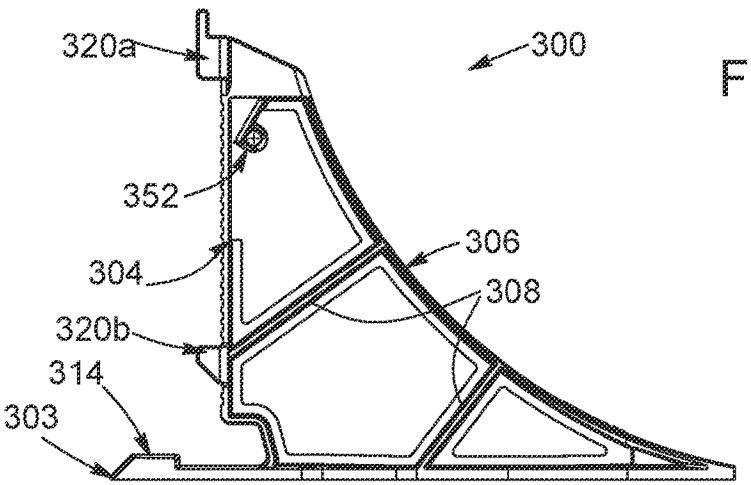
Figure 9A:
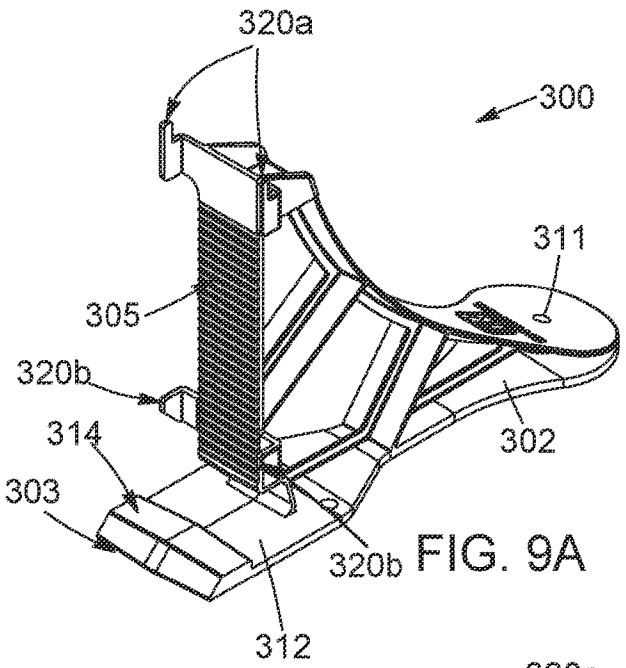

Referring now to FIGS. 9A to 9C, each anchor member 300 is substantially triangular and includes a ground-engaging member 302, an upright member 304 which extends substantially perpendicularly to the ground-engaging member 302, and a brace member 306 which extends between the ground-engaging member 302 and the upright member 304. In the illustrated embodiment, the brace member 306 is slightly curved concavely towards the ground-engaging member 302. Alternatively, the brace member 306 could instead be substantially straight or have any other suitable configuration.

In the illustrated embodiment, the anchor member 300 further includes a plurality of truss members 308 extending between the brace member 306 and the ground-engaging member 302 and between the brace member 306 and the upright member 304 to further rigidify the anchor member 300. Alternatively, the anchor member 300 could include only a single truss member, more than two truss members or may not include any truss members.

The anchor member 300 further includes a plurality of ground securing openings 310 defined in the ground-engaging member 302 for receiving fasteners such as stakes to secure the anchor member 300 to the ground surface. In the illustrated embodiment, a rear one 311 of the ground securing openings 310 extends through both the ground-engaging member 302 and the brace member 306.

Alternatively, the anchor member 300 may not include ground securing openings 310. Instead, the anchor member 300 could include one or more projections integrally formed within the ground-engaging member 302 to directly engage the ground without requiring additional fasteners such as stakes. In yet another embodiment, the anchor member 300 could be secured to the ground surface using any other suitable ground securing technique.

In the illustrated embodiment, the ground-engaging member 302 includes a forward portion 312 which extends forward of the upright member 304. In other words, the upright member 304 is spaced rearwardly from a front end 303 of the ground-engaging member 302. This configuration allows one or more sideboard sections 208, 210 to be received on the forward portion 312 such that the upright member 304 abuts the outer sideboard panel 240 of the one or more sideboard sections 208, 210. In the illustrated embodiment, the upright member 304 has a front face 305 which is textured. This may enhance friction between the upright member 304 and the outer sideboard panel(s) 240 when the upright brace member 306 extends against the outer sideboard panel(s) 240. Alternatively, the front face 305 may not be textured.

The anchor member 300 further includes a sideboard engaging projection 314 extending upwardly from the forward portion 312 of the ground-engaging member 302. The sideboard engaging projection 314 is configured for engaging one or more of the sideboard sections 208, 210 to locate the sideboard section 208, 210 relative to the anchor member 300 and to at least partially prevent lateral movement of the sideboard sections 208, 210 when the one or more sideboard sections 208, 210 is received on the forward portion 312 of the ground-engaging member 302.

In the illustrated embodiment, each anchor member 300 is positionable at an interface between adjacent sideboard sections 208, 210. Both the adjacent sideboard sections 208, 210 are therefore received on the forward portion 312 of the ground-engaging member 302. Specifically, the sideboard sections 208, 210 are received on the forward portion 312 of the ground-engaging member 302 such that the sideboard engaging projection 314 is received in adjacent receiving recesses 237' defined in the outer sideboard panels 240 of the adjacent sideboard sections 208, 210. Once received in this position, the outer sideboard panels 240 are prevented from moving inwardly and outwardly from the rink area 150, i.e., towards and away from a center of the rink area 150.

In the illustrated embodiment, the anchor member 300 can further include a pair of upper sideboard-engaging hooks 320*a* and a pair of lower sideboard-engaging hooks 320*b*. The pair of upper sideboard-engaging hooks 320*a* extends upwardly from a top end of the upright member 304, and the pair of lower sideboard-engaging hooks 320*b* extends substantially perpendicularly from a lower part of the upright member 304. The pair of upper sideboard-engaging hooks 320*a* and the pair of lower sideboard-engaging hooks 320*b* are configured for engaging one or more of the sideboard sections 208, 210, by complementary engaging the pair of upper sideboard-engaging hooks 320*a* into each one of the pair of upper anchor-receiving openings 246*a'* of the outer sideboard panel 240 of two consecutive sideboard sections 208, 210, and by complementary engaging the pair of lower sideboard-engaging hooks 320*b* into each one of the pair of lower anchor-receiving openings 246*b'* of the outer sideboard panel 240 of two consecutive sideboard sections 208, 210, to at least partially prevent lateral movement of the sideboard sections 208, 210.

Figure 10:
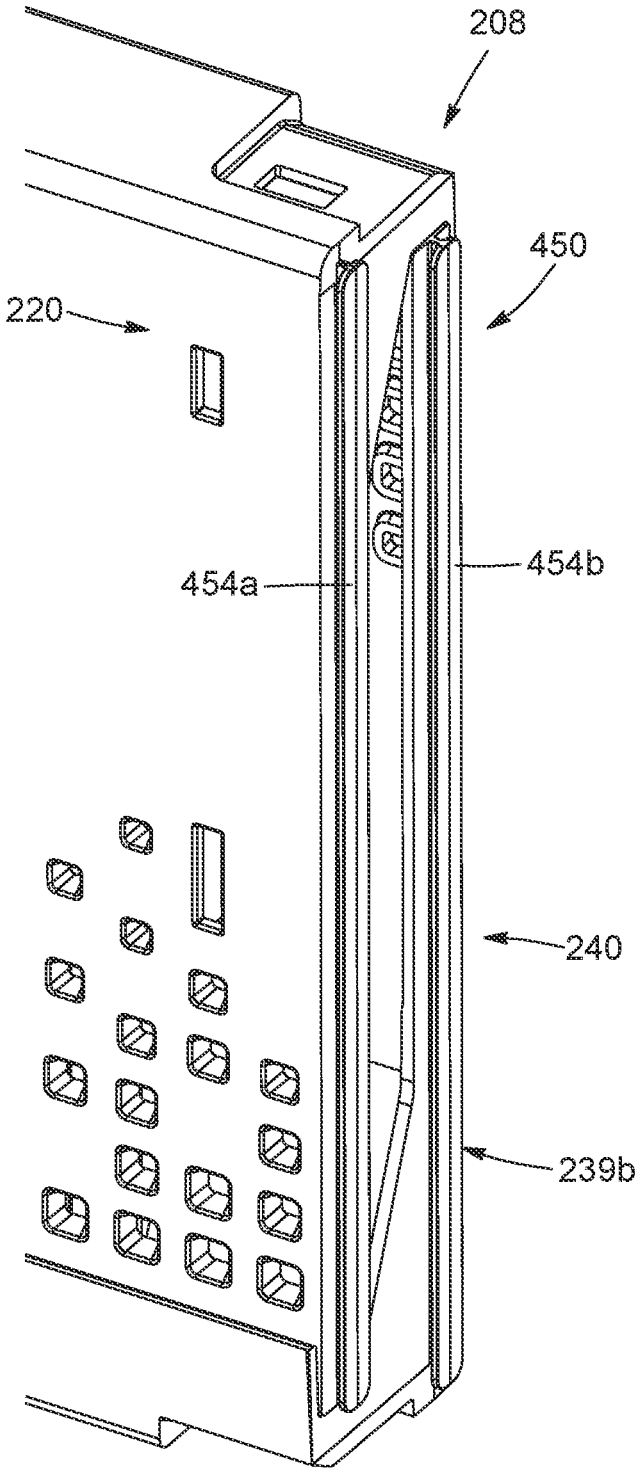
FIG. 10 is a perspective view of a portion of a sideboard section for the ice rink structure illustrated in FIG. 1, showing the first lateral connecting portion of the sideboard section.
Figure 11:
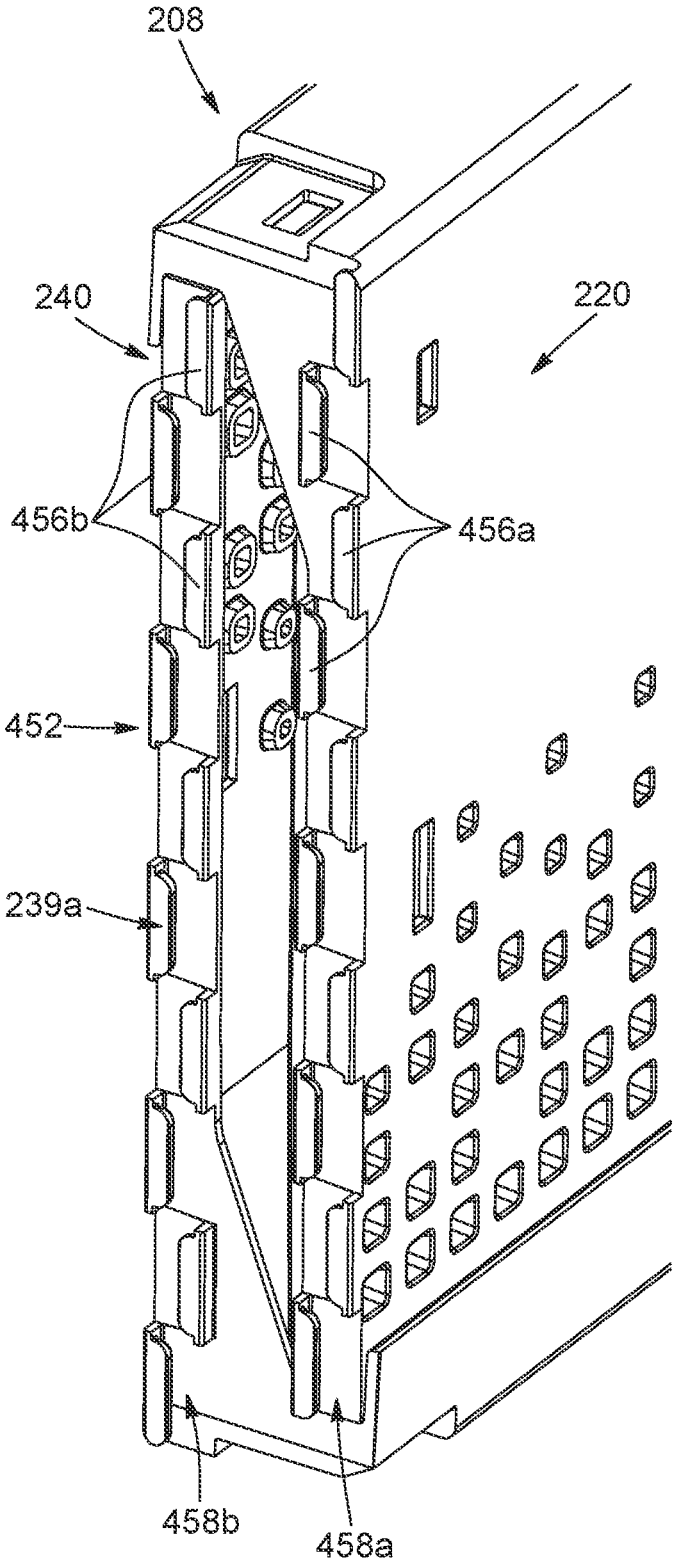
FIG. 11 is a perspective view of another portion of a sideboard section for the ice rink structure illustrated in FIG. 1, showing the second lateral connecting portion of the sideboard section.
Figure 12:
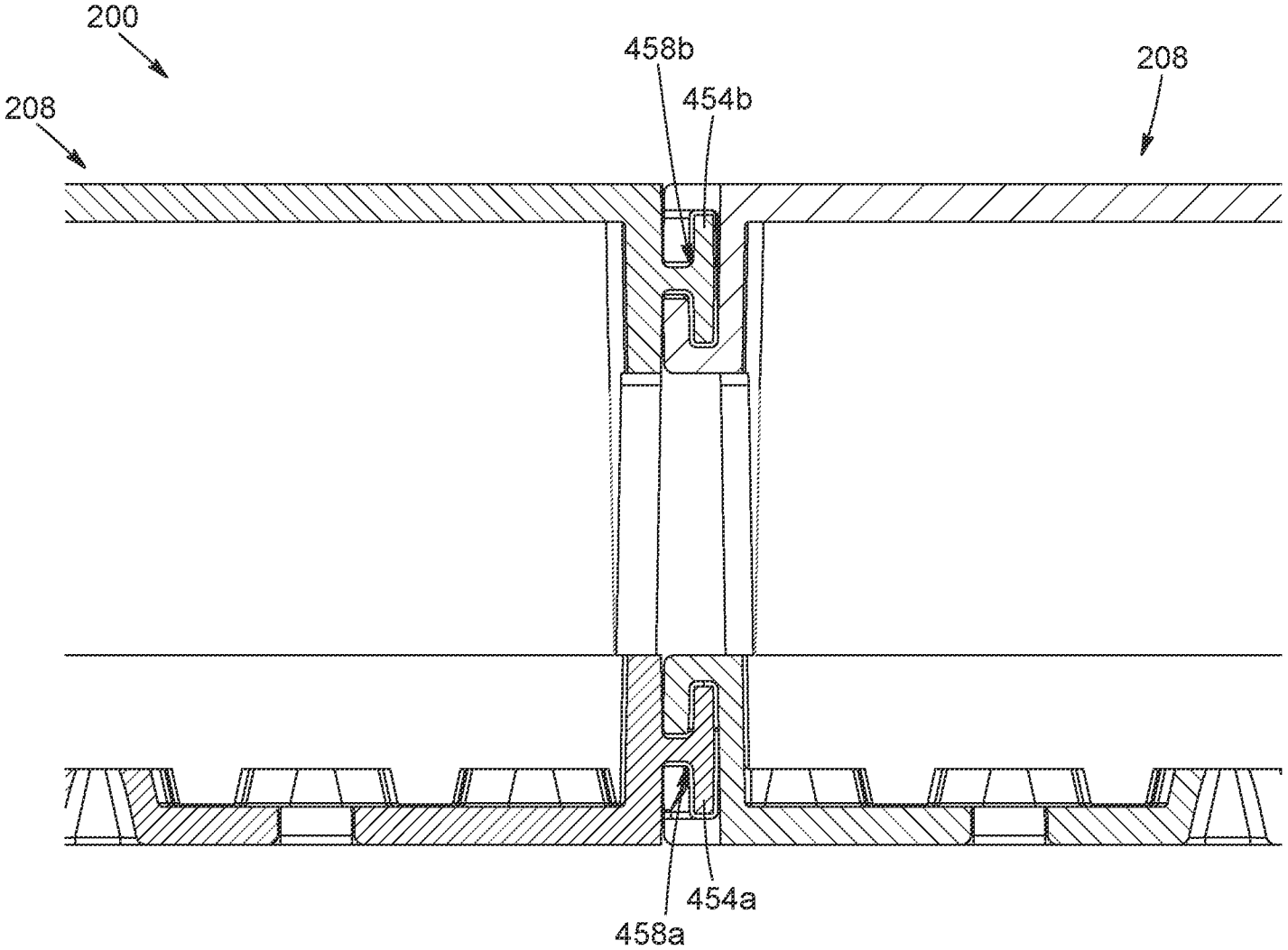
FIG. 12 is a cross-sectional view, taken along a horizontal cross-section plane, of two adjacent straight sideboard sections for the ice rink structure illustrated in FIG. 1, with the two adjacent straight sideboard sections directly connected together via their interconnected lateral connecting portions.

Referring to FIGS. 10 to 12, in the illustrated embodiment, each sideboard section 208, 210 includes first and second lateral connecting portions 450, 452 for connecting the sideboard section 208, 210 to adjacent sideboard sections 208, 210. Specifically, the first lateral connecting portion 450 is located on a first side end of the sideboard section 208 and is engageable with the second connecting portion 452 of a first adjacent sideboard section and the second lateral connecting portion 452 is configured to engageable with the first lateral connecting portion 450 of a second adjacent sideboard section.

In the illustrated embodiment, the first lateral connecting portion 450 is configured as a male connector and the second lateral connecting portion 452 is configured as a female connector for receiving the male connector. Specifically, the first lateral connecting portion 450 includes first and second substantially T-shaped projections 454*a*, 454*b*, each T-shaped projection 454*a*, 454*b* extending vertically along one of the inner and outer sideboard panels 220, 240. The second lateral connecting portion 452 includes a first plurality of hook shaped members 456*a* spaced apart from each other vertically along the inner sideboard panel 220 and a second plurality of hook shaped members 456*b* spaced apart from each other vertically along the outer sideboard panel 240. The first plurality of hook shaped members 456*a* extend towards each other so as to form a first vertical receiving channels 458*a* sized and shaped for snuggly receiving respectively the first T-shaped projection 454*a*, and the second plurality of hook shaped members 456*b* extend towards each other so as to form a second vertical receiving channels 458*b* sized and shaped for snuggly receiving respectively the second T-shaped projection 454*b*.

In the illustrated embodiment, the ice rink structure 100 further includes a plurality of sideboard section connectors 500 to connect together adjacent sideboard sections 208, 210. In the illustrated embodiment, the sideboard section connectors 500 further connect the adjacent sideboard sections 208, 210 to the corresponding anchor member 300 located at the interface between the adjacent sideboard sections 208, 210.

Figure 13C:
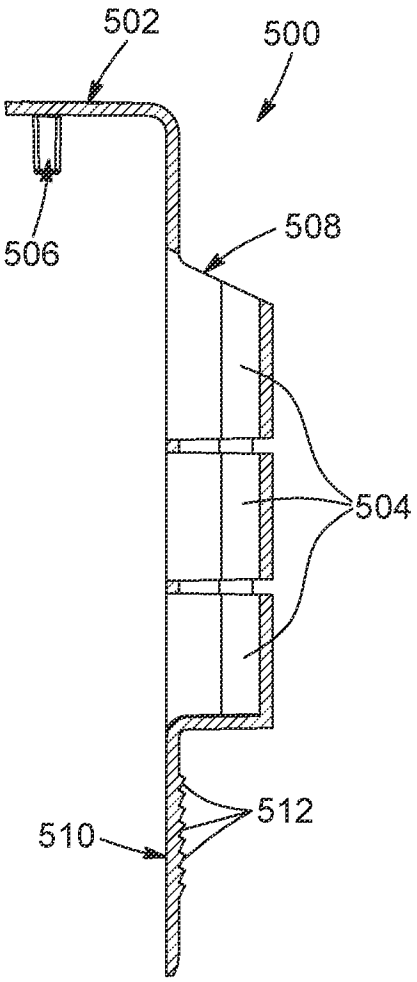
FIGS. 13A, 13B and 13C are perspectives views and side elevation view of a sideboard section connector to connect together adjacent sideboard sections for the ice rink structure illustrated in FIG. 1.
Figure 13B:
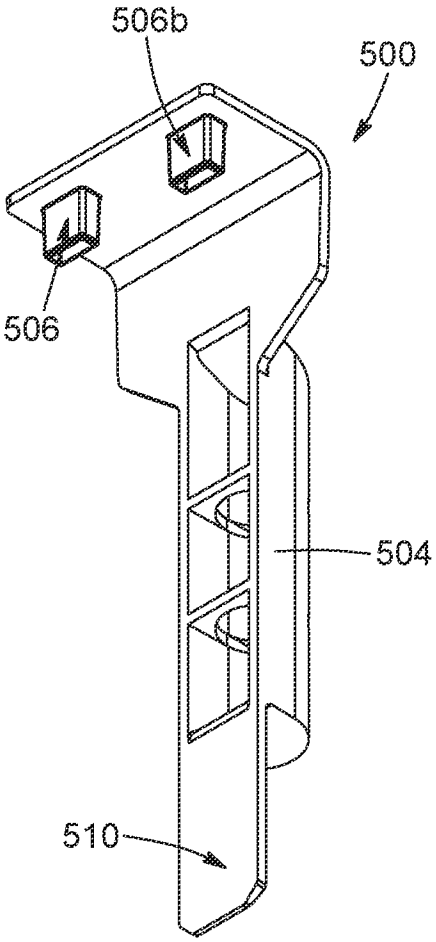
Figure 13A:
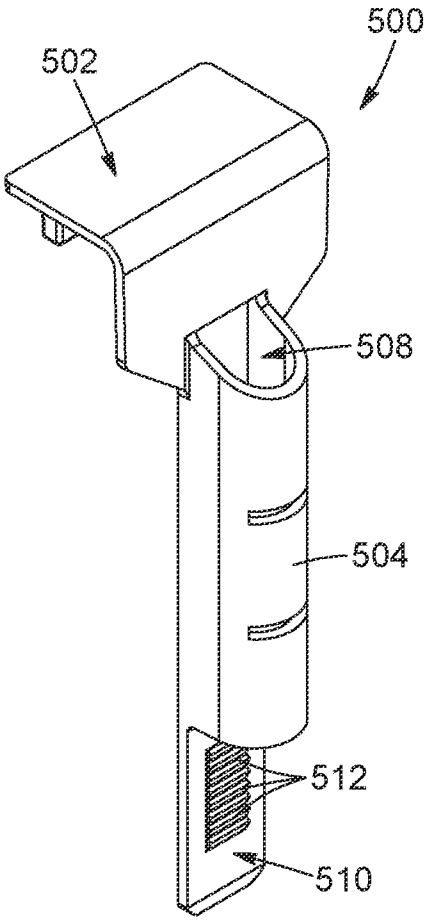

Referring to FIGS. 13A to 13C, in the illustrated embodiment, each sideboard section connector 500 includes a top hook-shaped portion 502 and an elongated shaft member 504 extending away from the top hook-shaped portion 502. The top hook-shaped portion 502 is sized and shaped to engage the rim portion 228 of the inner sideboard panel 220, and more specifically to be snuggly received in adjacent connector recesses 237 of the adjacent sideboard sections 208, 210, which form together a fully enclosed recess when the sideboard sections 208, 210 are positioned adjacent each other.

The sideboard section connector 500 further includes a pair of sideboard-engaging projections 506 which extend downwardly from the top hook-shaped portion 502. Each sideboard-engaging projection 506 is sized and shaped to engage the corresponding connector-receiving opening 239 defined in the rim portions 228 of the adjacent sideboard sections 208, 210 when the top hook-shaped portion 502 is received in the connector recesses 237. When the sideboard section connector 500 engages both adjacent sideboard sections 208, 210, the adjacent sideboard sections 208, 210 are therefore prevented from moving laterally relative to each other. In other words, the sideboard section connector 500 maintains the adjacent sideboard sections 208, 210 in abutment against each other.

Alternatively, the top hook-shaped portion 502 may not engage connector-receiving openings and/or connector recesses of the sideboard sections and may instead have any other configuration suitable for connecting together the adjacent sideboard sections.

Figure 14:
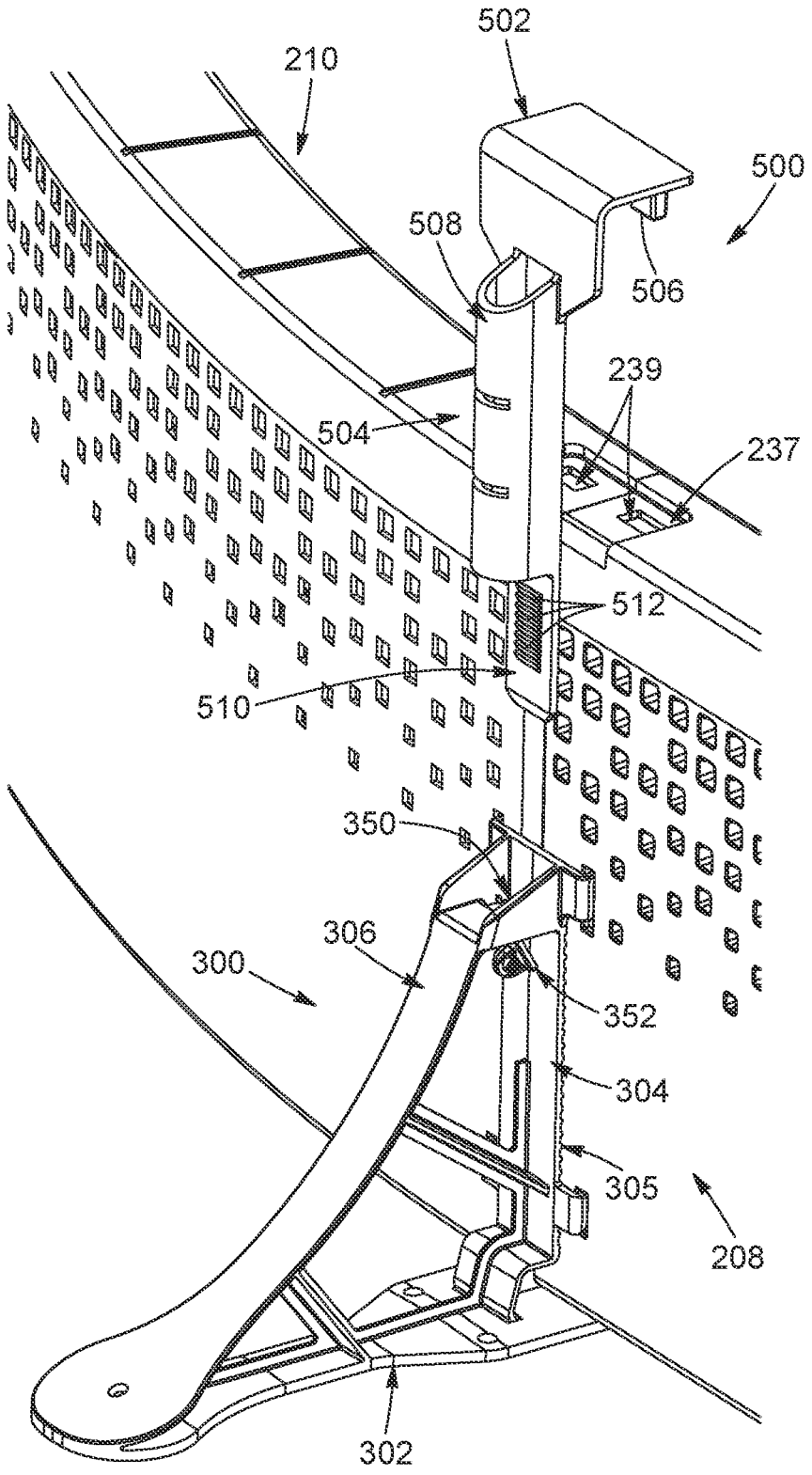
FIG. 14 is a portion of a sideboard and the anchor member for the ice rink structure illustrated in FIG. 1, showing the anchor member engaging two adjacent sideboard sections and the sideboard section connector located above the anchor member.
Figure 15:
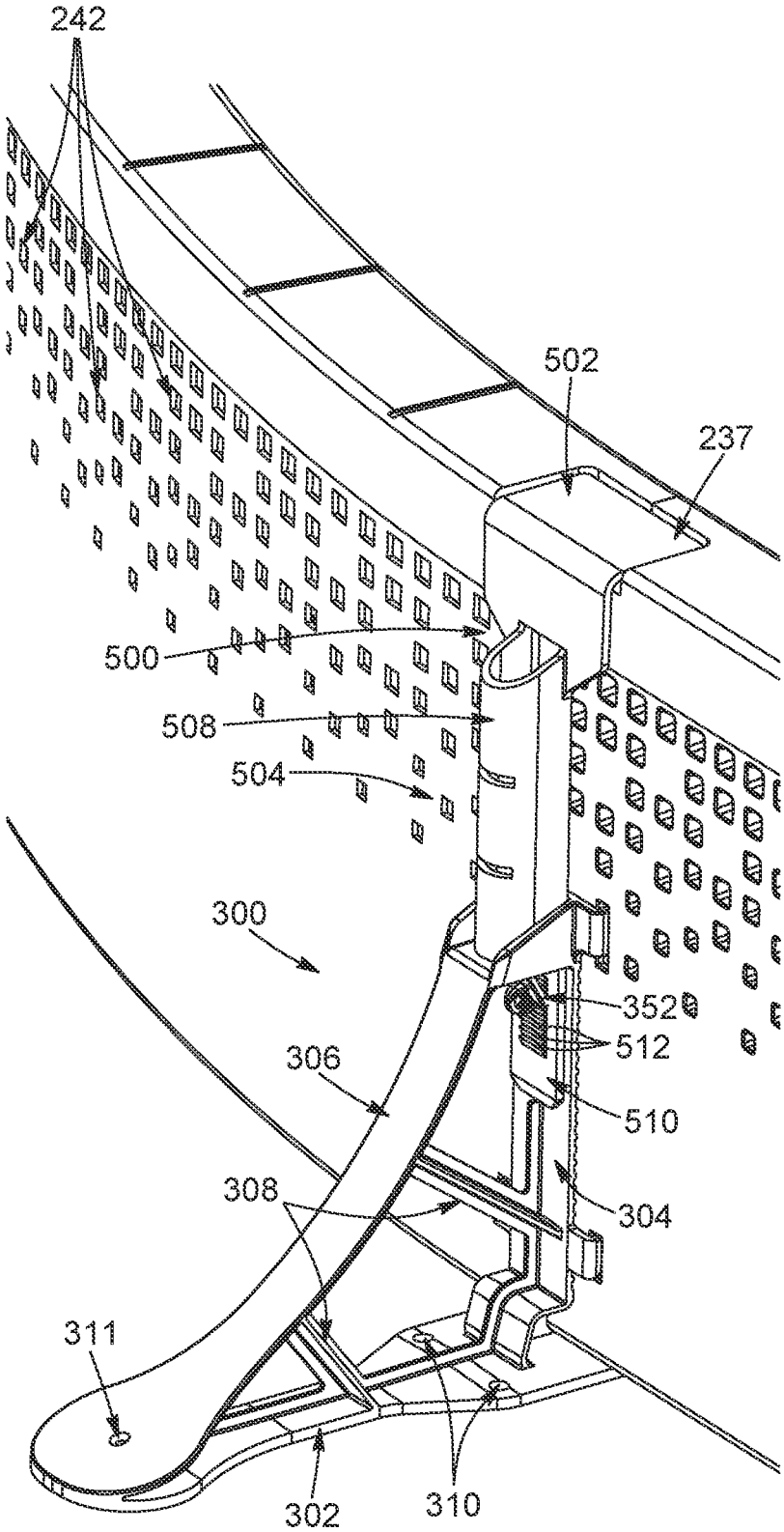
FIG. 15 is a portion of a sideboard and an anchor member for the ice rink structure illustrated in FIG. 1, showing the anchor member engaging two adjacent sideboard sections and a sideboard section connector engaging the anchor member.

In the illustrated embodiment, the elongated shaft member 504 includes a bottom connection tab 510 which is configured for engaging the corresponding anchor member 300. More specifically, and as best shown in FIG. 9B, the anchor member 300 includes a receiving slot 350 which is located at the intersection between the upright member 304 and the brace member 306 and which faces upwardly. The receiving slot 350 is sized and shaped to receive the bottom connection tab 510. As best shown in FIG. 14, the bottom connection tab 510 engages the receiving slot 350 in a ratchet-type configuration. More specifically, the bottom connection tab 510 includes a plurality of ridges 512 extending in a widthwise direction. The anchor member 300 includes a pawl member 352 which extends generally from the brace member 306 downwardly and forward towards the upright member 304. When the sideboard section connector 500 engages the anchor member 300, the bottom connection tab 510 slides into the receiving slot 350 and downwardly against the upright member 304. As the bottom connection tab 510 moves further downwardly, the ridges 512 contact the pawl member 352. The pawl member 352 is substantially resilient and is configured to move away from the bottom connection tab 510 as the sideboard section connector 500 is lowered to allow the bottom connection tab 510 to slide downwardly freely and with substantially no resistance. On the other hand, the pawl member 352 is also configured to engage the ridges 512 and prevent the sideboard section connector 500 from being moved upwardly. This ensures that the sideboard section connector 500 remains engaged with the anchor member 300. FIG. 15 shows the sideboard section connector 500 fully engaged in the anchor member 300, with the pawl member 352 securing the engagement.

To remove the sideboard section connector 500, a user may pull on the pawl member 352 to resiliently move the pawl member 352 away from the bottom connection tab 510 until the ridges 512 clear the pawl member 352, which allows the sideboard section connector 500 to be moved upwardly relative to the anchor member 300.

In one embodiment, the pawl member 352 may be configured to be pulled manually by the user. In another embodiment, the pawl member 352 may be configured to be pullable using a tool, such as a screwdriver or the like. In yet another embodiment, the pawl member may not be pullable and may instead be movable using any other suitable mechanism that would allow the user to disengage the pawl member from the ridges of the bottom connection tab 510. In still another embodiment, the sideboard section connector 500 and the anchor member 300 may not be connectable together in a ratchet-like configuration and may instead be connected to each other using any other suitable connection mechanism.

In the illustrated embodiment, the elongated shaft member 504 of the sideboard section connector 500 further includes a sleeve portion 508 extending between the top hook-shaped portion 502 and the bottom connection tab 510. The sleeve portion 508 is configured to allow one or more accessories to be attached to the sideboard 200. For example, the sleeve portion 508 may be sized and shaped to receive a pole extending upwardly from the sideboard, and netting could extend between consecutive poles extending upwardly from consecutive anchor members 300. The sleeve portion 508 could also be adapted for receiving connectors for extension sideboard panels that could be positioned on top of the sideboard 200 to thereby extend a height of the sideboard 200 in at least some locations around the ice rink 10. Alternatively, the anchor member 300 could include any other accessory connector for connecting one or more accessories to the sideboard 200, or may not include any accessory connector.

Referring to FIGS. 17 to 24, in the illustrated embodiment, when one of the curved sideboard sections 210 is connected with one of the straight sideboard sections 208, the lateral end 238*a*, 238*b* of the inner sideboard panel 220 of the two sideboard sections 208, 210 abut each other, but the lateral ends 239*a*, 239*b* of the outer sideboard panels 240 are spaced from each other. Moreover, when two of the curved sideboard sections 210 are connected to each other, the lateral ends 239*a*, 239*b* of the outer sideboard panels 240 are spaced even further from each other.

The structure 100 further includes a plurality of connecting members 600 to connect the lateral ends 239*a*, 239*b* of the outer sideboard panels 240 together.

In the embodiment illustrated in FIGS. 17 to 20, the connecting members 600 include a straight-to-curved connecting member 610 for connecting a straight sideboard section 208 to a curved sideboard section 210. Specifically, the straight-to-curved connecting member 610 includes an elongated extrusion comprising a substantially rectangular central body 612, a substantially T-shaped projection 614 extending away from the rectangular central body 612 and a T-shaped receiving channel 616 extending away from the rectangular central body 612, opposite the T-shaped projection 614. The T-shaped projection 614 is substantially similar to the T-shaped projections 454*a*, 454*b* located on the inner and outer sideboard panels 220, 240 and is adapted to engage the corresponding vertical receiving channel 458*a*, 458*b* of one of the sideboard sections 208, 210. The T-shaped receiving channel 616 is substantially similar to the vertical receiving channels 458*a*, 458*b* located on the inner and outer sideboard panels 220, 240 and is sized and shaped to receive the T-shaped projection 454*a*, 454*b* of the other one of the sideboard sections 208, 210.

In this embodiment, the connecting member 610 further includes first and second U-shaped portions 630, 632 sized and shaped for receiving the outer sideboard triangular panels 233' of the outer sideboard panels 240. Specifically, each U-shaped portion 630, 632 is defined between an inner arm 634 and an outer arm 636 spaced apart from the inner arm 634. Alternatively, the connecting member 610 may not have first and second U-shaped portions 630, 632.

It will be understood that when a straight sideboard sections 208 and a curved sideboard sections 210 are placed adjacent each other and connected to each other end-to-end, the outer sideboard triangular panels 233' of the adjacent straight and curved sideboard sections 208, 210 are not fully parallel to each other but are instead angled relative to each other. Therefore, in this embodiment, the outer arms 636 are nonparallel to the inner arms 634. In other words, the outer arms 636 are angled away from the inner arms 634. This allows the outer sideboard triangular panels 233' of the adjacent curved sideboard sections 210 to abut and extend along the outer arms 636.

Figure 19:
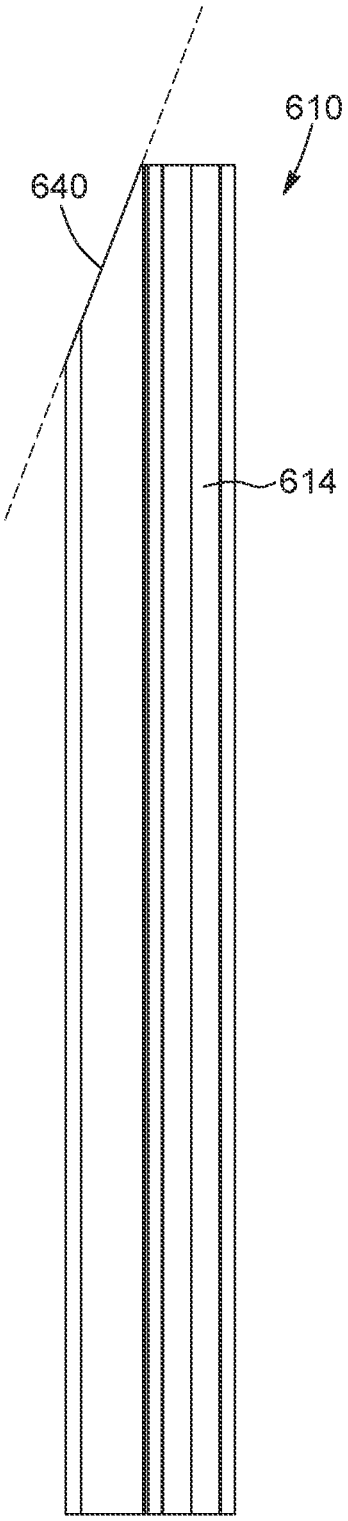
FIG. 19 is a side elevation view of the straight-to-curved connection member illustrated in FIG. 18.
Figure 20:
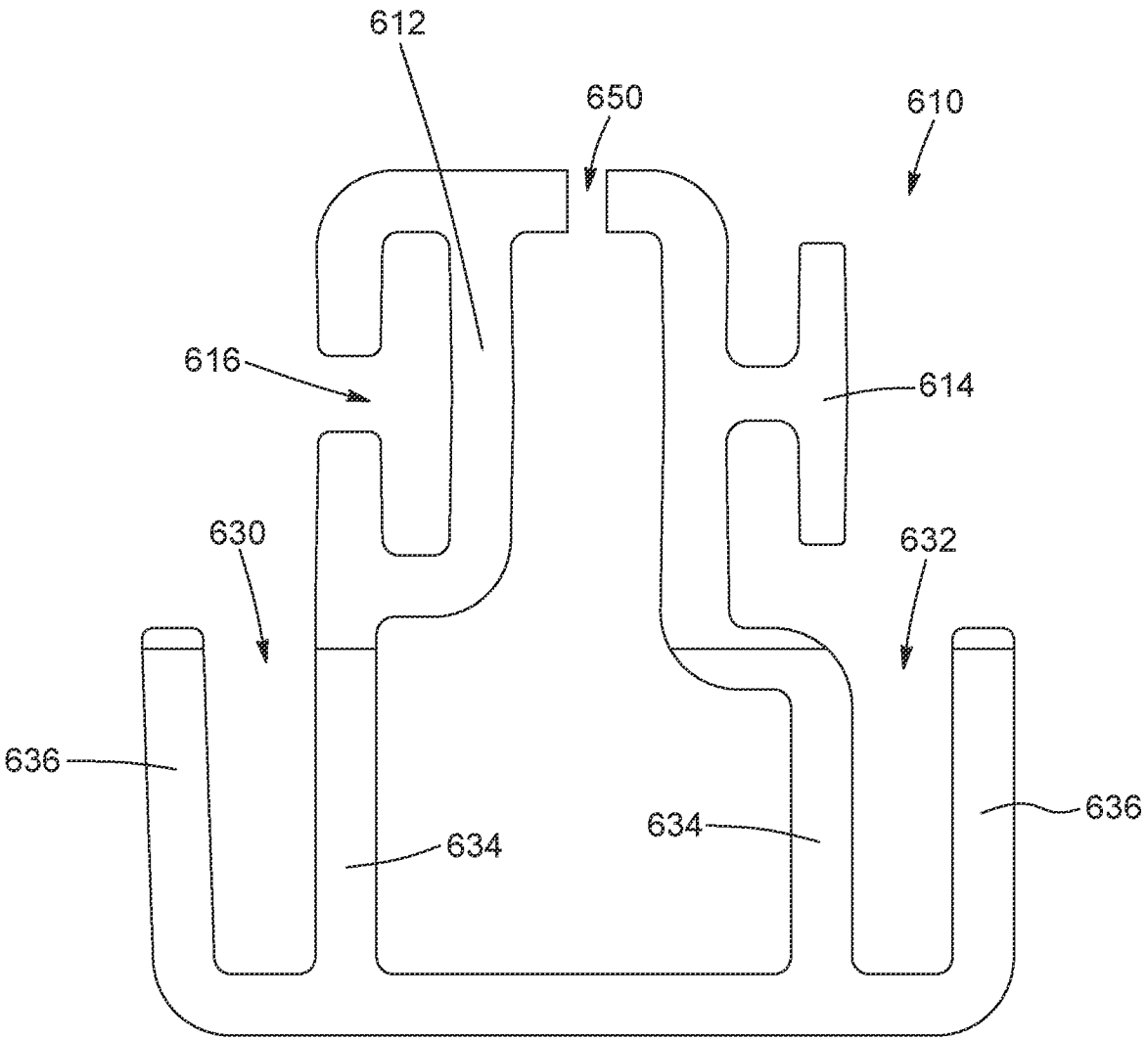
FIG. 20 is a top plan view of the straight-to-curved connection member illustrated in FIG. 18.

As further shown in FIG. 19, the connecting member 610 further has an angled top surface 640 which prevent the connecting member 610 from interfering with the inner sideboard triangular panels 233*a*, 233*b* of the inner sideboard panels 220. Alternatively, the connecting member 610 may not have an angled top surface 640.

In some embodiment, the connecting member 610 can further comprises an adjusting slot 650 along the entire length of the rectangular central body 612, between the T-shaped receiving channel 616 and the T-shaped projection 614. The adjusting slot 650 provides resilience to the connecting member 610 and facilitates insertion of the connecting member 610 by slightly compressing the connecting member 610 before sliding downwardly the connecting member 610 between the adjacent straight sideboard section 208 and the curved sideboard sections 210. When inserted, the resilience of the connecting member 610 allows the connecting member 610 to expand and securely connect the adjacent straight sideboard section 208 and the curved sideboard sections 210.

Figure 17:
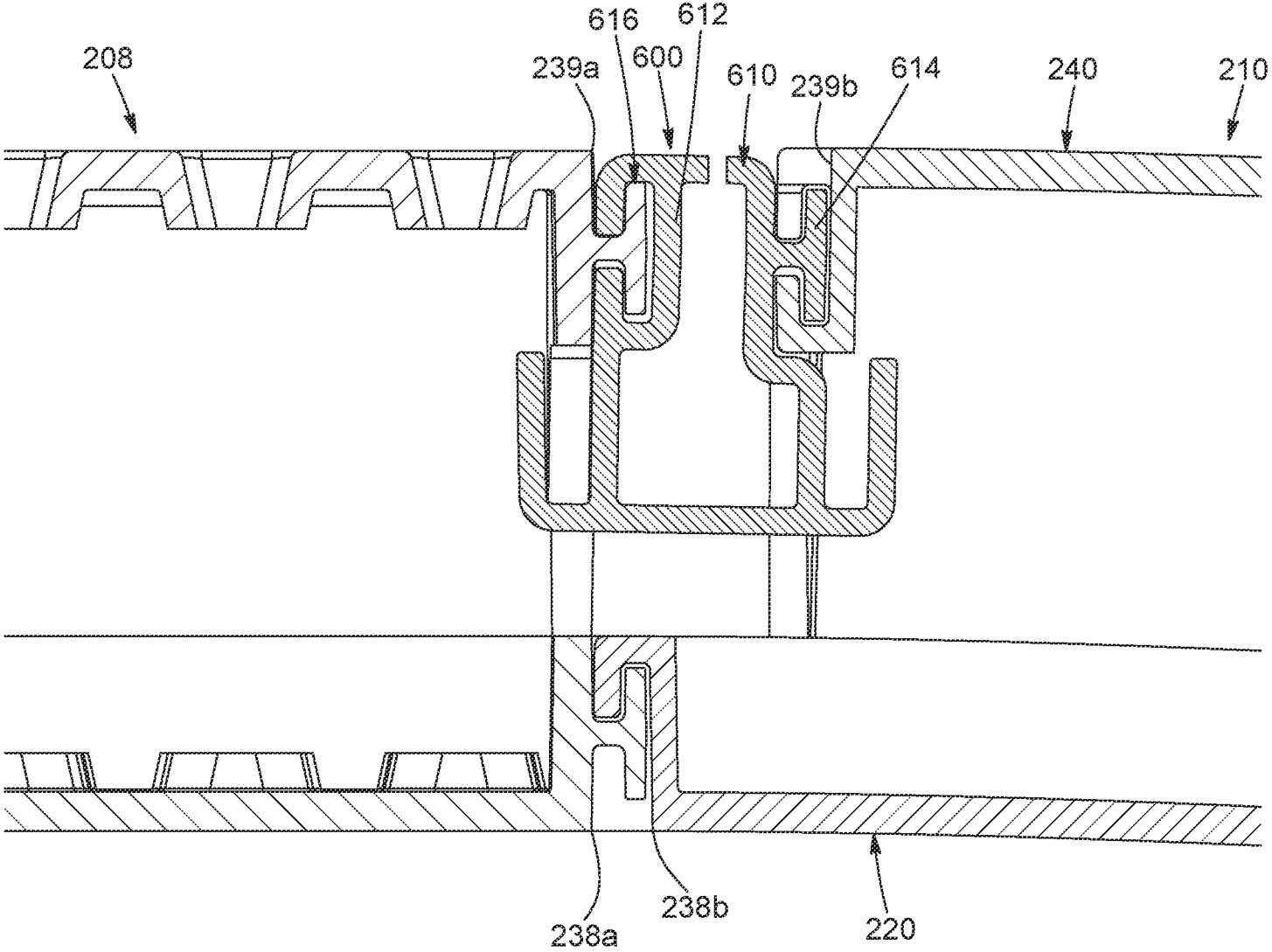
FIG. 17 is a cross-sectional view, taken along a horizontal cross-section plane, of a straight sideboard section and a curved sideboard section for the ice rink structure illustrated in FIG. 1, with the two sideboard sections positioned adjacent each other and connected together via a straight-to-curved connecting member, in accordance with one embodiment.
Figure 18:
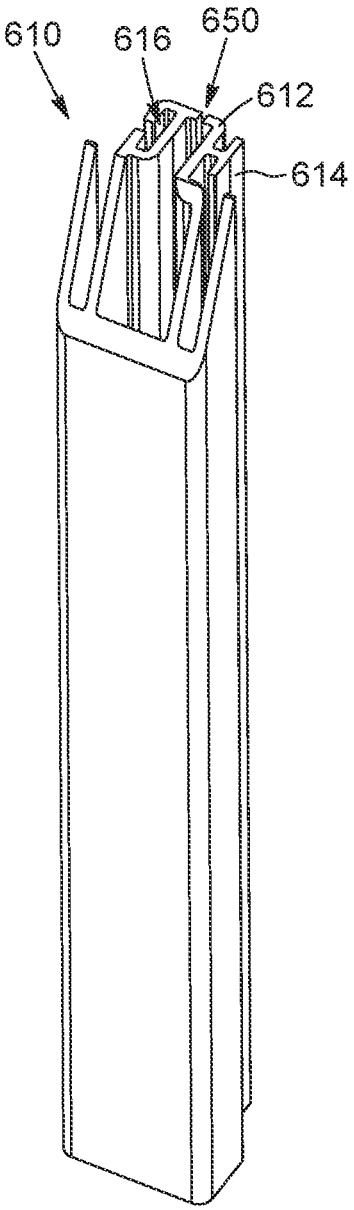
FIG. 18 is a perspective view of a straight-to-curved connection member for the ice rink structure illustrated in FIG. 1, in accordance with another embodiment.
Figure 21:
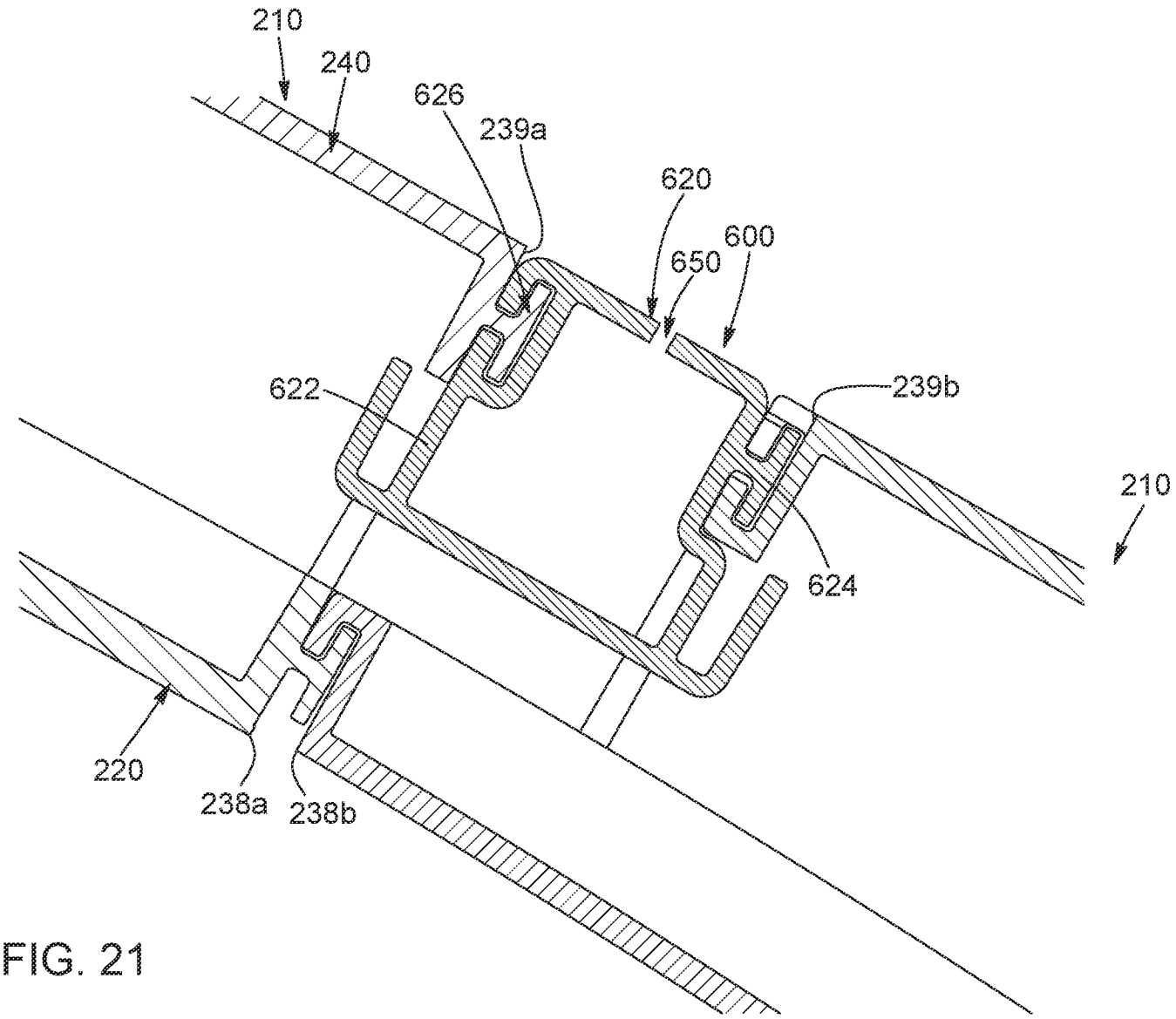
FIG. 21 is a cross-sectional view, taken along a horizontal cross-section plane, of two adjacent curved sideboard sections for the ice rink structure illustrated in FIG. 1, with the two sideboard sections positioned adjacent each other and connected together via a curved-to-curved connecting member, in accordance with one embodiment.
Figure 22:
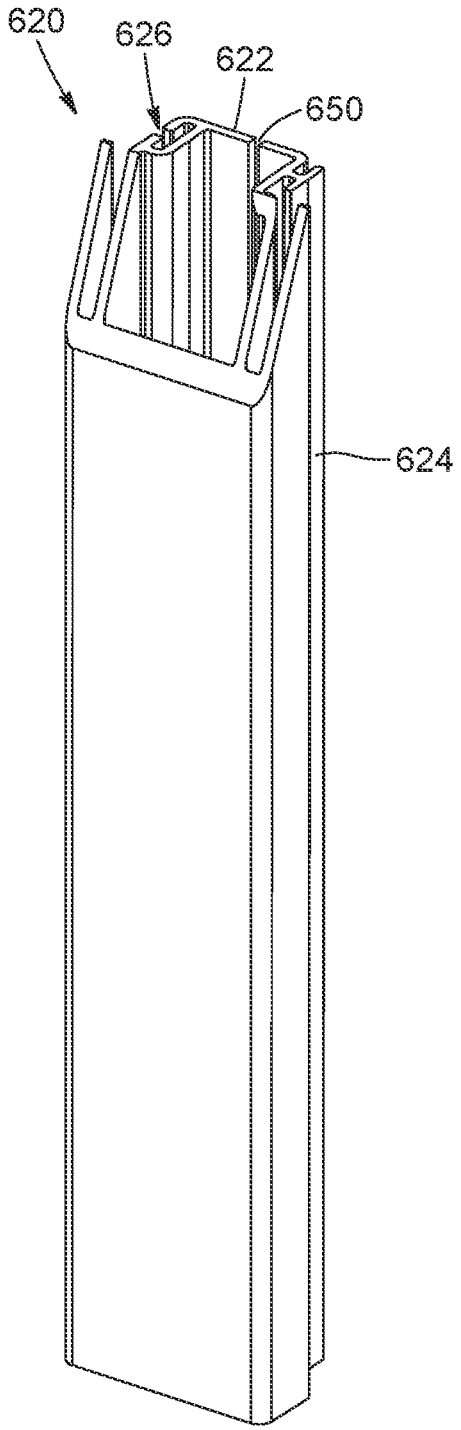
FIG. 22 is a perspective view of a curved-to-curved connection member for the ice rink structure illustrated in FIG. 1, in accordance with another embodiment.

In the embodiment illustrated in FIGS. 21 to 24, the connecting members 600 further include a curved-to-curved connecting member 620 for connecting two curved sideboard sections 210 together. Specifically, the curved-to-curved connecting member 620 includes an elongated extrusion comprising a substantially rectangular central body 622, a substantially T-shaped projection 624 extending away from the rectangular central body 622 and a T-shaped receiving channel 626 extending away from the rectangular central body 622, opposite the T-shaped projection 624. The T-shaped projection 624 is substantially similar to the T-shaped projections 454*a*, 454*b* located on the inner and outer sideboard panels 220, 240 and is adapted to engage the corresponding vertical receiving channel 458*a*, 458*b* of one of the sideboard sections 210. The T-shaped receiving channel 626 is substantially similar to the vertical receiving channels 458*a*, 458*b* located on the inner and outer sideboard panels 220, 240 and is sized and shaped to receive the T-shaped projection 454*a*, 454*b* of the other one of the sideboard sections 210. As shown in FIGS. 17 and 21, since the outer sideboard panels 240 of adjacent sideboard sections 210 are further apart when the two adjacent sideboard sections are curved sideboard sections 210 than when they include a straight sideboard portion and a curved sideboard portion, the rectangular central body 622 of the curved-to-curved connecting member 620 is substantially longer than the rectangular central body 612 of the straight-to-curved connecting member 610.

In this embodiment, the connecting member 620 further includes first and second U-shaped portions 630, 632 sized and shaped for receiving the outer sideboard triangular panels 233' of the outer sideboard panels 240. Specifically, each U-shaped portion 630, 632 is defined between an inner arm 634 and an outer arm 636 spaced apart from the inner arm 634. Alternatively, the connecting member 620 may not have first and second U-shaped portions 630, 632.

It will be understood that when two of the curved sideboard sections 210 are placed adjacent each other and connected to each other end-to-end, the outer sideboard triangular panels 233' of the adjacent curved sideboard sections 210 are even more not fully parallel to each other but are instead angled relative to each other. Therefore, in this embodiment, the outer arms 636 are nonparallel to the inner arms 634. In other words, the outer arms 636 are angled away from the inner arms 634. This allows the outer sideboard triangular panels 233' of the adjacent curved sideboard sections 210 to abut and extend along the outer arms 636.

Figure 23:
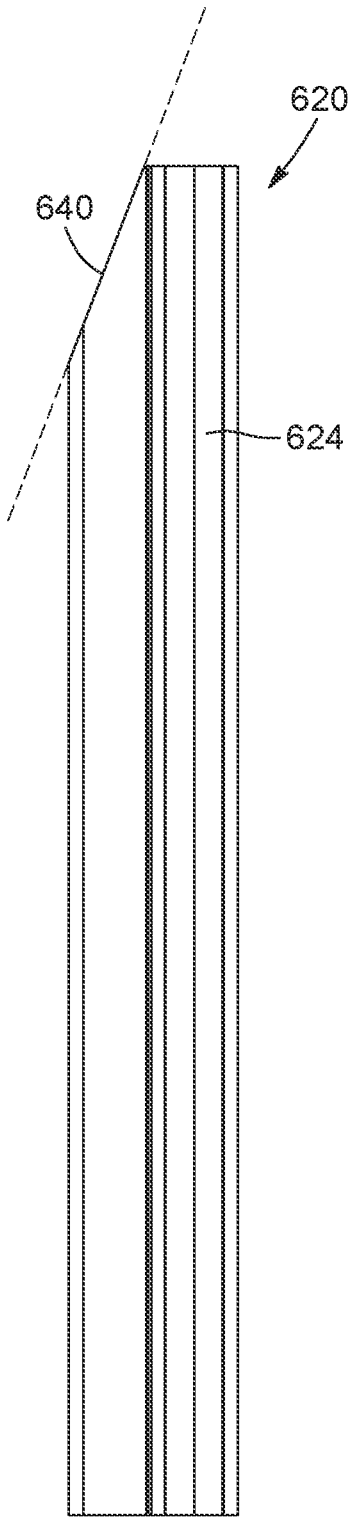
FIG. 23 is a side elevation view of the curved-to-curved connection member illustrated in FIG. 22.
Figure 24:
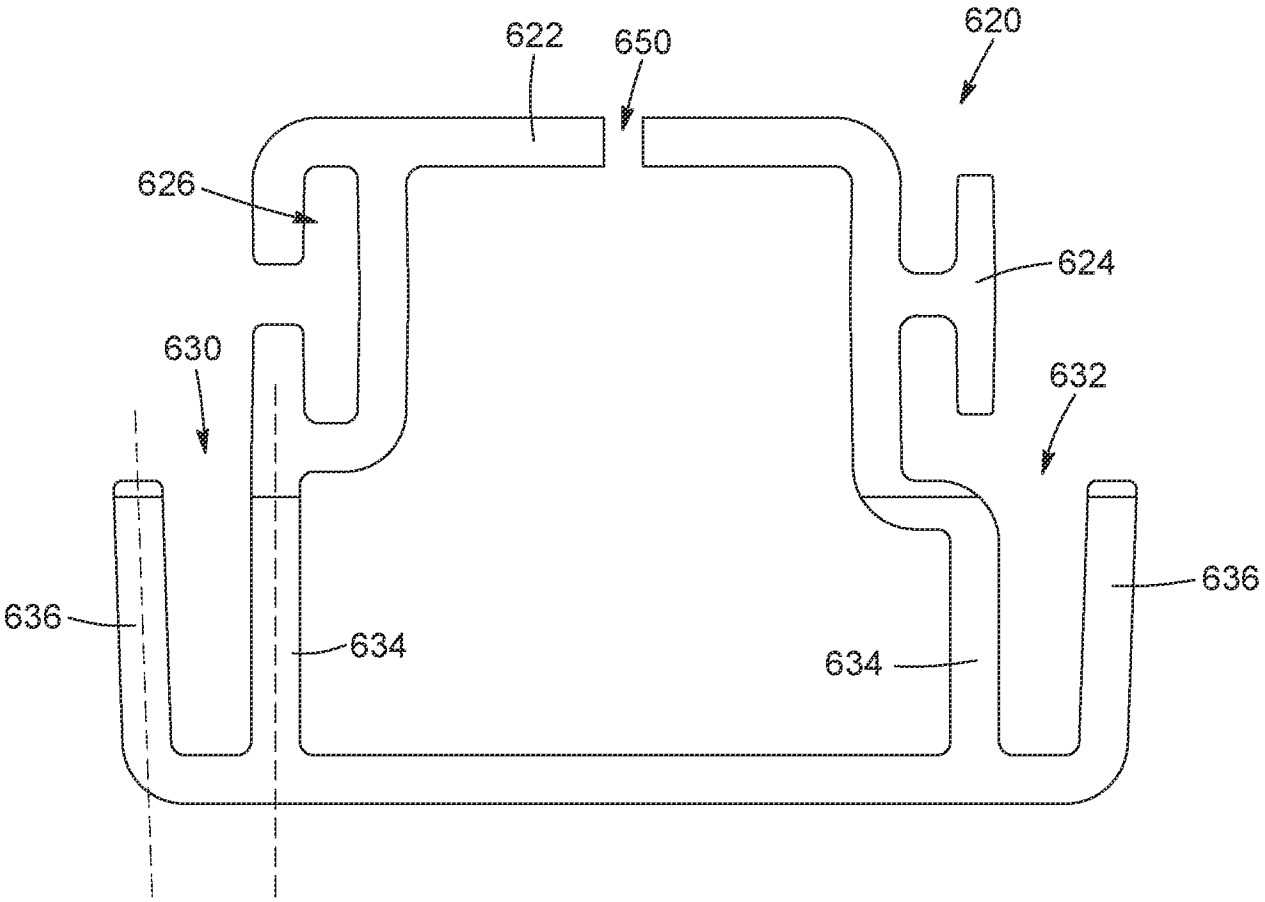
FIG. 24 is a top plan view of the curved-to-curved connection member illustrated in FIG. 22.

As further shown in FIG. 23, the connecting member 620 further has an angled top surface 640 which prevent the connecting member 620 from interfering with the inner sideboard triangular panels 233*a*, 233*b* of the inner sideboard panels 220. Alternatively, the connecting member 620 may not have an angled top surface 640.

In some embodiment, the connecting member 620 can further comprises an adjusting slot 650 along the entire length of the rectangular central body 622, between the T-shaped receiving channel 626 and the T-shaped projection 624. The adjusting slot 650 provides resilience to the connecting member 620 and facilitates insertion of the connecting member 620 by slightly compressing the connecting member 620 before sliding downwardly the connecting member 620 between the two adjacent curved sideboard sections 210. When inserted, the resilience of the connecting member 620 allows the connecting member 620 to expand and securely connect the two adjacent curved sideboard sections 210.

In yet another embodiment, the connecting members 600 may include any other connecting member having any other suitable configuration. In still another embodiment, the structure 100 may not include any connecting members and the outer sideboard panels 240 of two adjacent curved sideboard sections 210 or of a curved sideboard section 210 adjacent a straight sideboard section 208 could instead abut each other and be connected directly to each other without connecting members.

To construct the ice rink 10 using the ice rink structure 100, the ice rink structure 100 as described above is first provided. In one embodiment, the ice rink structure 100 could be provided as a kit for an ice rink structure, in which all the components of the ice rink structure 100 illustrated above are provided as separate components to be assembled together by the user. In some embodiments, at least some of the components could be preassembled together to facilitate assembly by the user.

The outer sideboard panels 240 of the sideboard sections 208, 210 may be placed such that they extend substantially vertically, with the base portion 228' of the outer sideboard panel 240 located on the ground surface. The outer sideboard panels 240 may be positioned together end-to-end so as to abut each other.

In some embodiment, the outer sideboard panels 240' comprising ridges 229 on the rim portion 228 can be slightly bended by the user to form the curved sideboard sections 210.

Specifically, the lateral connecting portions 450, 452 of the sideboard sections 208, 210 may be engaged with each other as described above. In cases in which a straight sideboard section 208 is connected to a curved sideboard section 210, the straight-to-curved connecting member 610 can be used as described above. Similarly, in cases in which two curved sideboard sections 210 are connected together, the curved-to-curved connecting member 620 can be used as described above.

In one embodiment, a corresponding anchor member 300 could first be placed at a desired location and engaged to two consecutive outer sideboard panels 240 by inserting horizontally the pair of upper sideboard-engaging hooks 320*a* of the anchor member 300 into the corresponding upper anchor-receiving openings 246*a'* of each of the two consecutive outer sideboard panels 240, and by pivoting downwardly the anchor member 300 toward the two consecutive outer sideboard panels 240 until the outer sideboard panels 240 abuts the upright member 304, the sideboard engaging projection 314 of the anchor member 300 is received in adjacent receiving recesses 237' defined in the outer sideboard panels 240, and the pair of lower sideboard-engaging hooks 320*b* of the anchor member 300 is snugly fitted in the corresponding lower anchor-receiving openings 246*b'*. The anchor member 300 can further be secured to the ground surface using one or more fasteners such as stakes inserted in at least one of the ground securing openings 310, 311 of the ground-engaging member 302.

Once all the outer sideboard panels 240 have been positioned end-to-end in a desired configuration, e.g., to form a loop, the liner member 400 can then be laid out and positioned such that the outer liner edge portion 404 extends over the outer sideboard panels 240. The matching inner sideboard panels 220 can then be placed over the outer sideboard panels 240 as described above to form the sideboard sections 208, 210, with the outer liner edge portion 404 being positioned between the inner and outer sideboard panels 220, 240. In some embodiment, the inner sideboard panels 220' comprising ridges 229 on the rim portion 228 can be slightly bended by the user to form the curved sideboard sections 210.

In some embodiments, the user may not use a liner member 400. In this case, the matching inner sideboard panels 220 are still placed over the outer sideboard panels 240 as described above to form the sideboard sections 208, 210 and the sideboard cavity 250 within the sideboard sections 208, 210.

Each sideboard section connector 500 can then be positioned above a corresponding anchor member 300 and the sideboard section connector 500 can be lowered such that the bottom connection tab 510 engages the receiving slot 350 of the anchor member 300 and slides against the upright member 304, until the top hook-shaped portion 502 is received in the connector recesses 237 and the sideboard-engaging projections 506 engage the corresponding connector-receiving openings 239 of the sideboard section 208, 210, thus forming the ice rink 10.

Water can then be provided on the liner member 400, in one instance or multiple instances as described above, to form the ice layer.

To disassemble the ice rink structure 100, the user can pull on the pawl members 352 and pull the sideboard section connectors 500 upwardly to disengage the sideboard section connectors 500 from the anchor members 300. The inner sideboard panels 220 can then be removed from the outer sideboard panels 240 and the liner member 400 can also be removed from the outer sideboard panels 240. The outer sideboard panels 240 can then be removed and the anchor members 300 can be unfastened from the ground surface (by removing the stakes for example) and removed as well.

It will be understood that the embodiments of the ice rink structure described above are merely provided as examples and that various alternative configurations may be considered.

For example, the anchor members 300 could be located at various other locations along the sideboard 200, and not just at the interface between adjacent sideboard sections. The anchor members 300 could have various other configurations, or the ice rink structure 100 may not include any anchor members.

In the illustrated embodiment, the sideboard openings 260 are shown in all of the sideboard sections, straight 208 or curved 210. Alternatively, the sideboard openings 260 could be defined only in the curved sideboard sections 210, or could be defined only in the straight sideboard sections 208. The sideboard openings 260 could be defined in only some of the sideboard sections 208, 210, or in all of the sideboard sections 208, 210.

In another embodiment, instead of the liner member 400 comprising a flexible membrane, the liner member 400 could instead include a solid floor extending across the rink area. Alternatively, the liner member 400 could have any other suitable configuration.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The following aspects are also disclosed herein:

1. An ice rink structure comprising:
   - a sideboard securable to a ground surface and delimiting a rink area adjacent the sideboard for receiving water such that an ice surface is formed in the rink area by freezing of the water, the sideboard being hollow and having a sideboard cavity defined therein, the sideboard including a plurality of sideboard sections disposable side-by-side and securable together,
   - wherein each sideboard sections comprises an inner sideboard panel facing towards the rink area and an outer sideboard panel spaced from the inner sideboard panel, away from the rink area, to form the sideboard cavity therebetween,
   - wherein at least one of the inner sideboard panels comprises at least one sideboard opening proximal a bottom sideboard end for providing fluid communication between the rink area and the sideboard cavity to allow water from the rink area to enter the sideboard cavity.

2. The ice rink structure as described in aspect 1, further comprising a liner member extending across the rink area to receive water to be frozen, the liner member including an outer liner edge and a liner edge portion extending from the outer liner edge towards a center of the liner member, the liner edge portion extending into the sideboard cavity such that the water from the rink area entering the sideboard cavity through the at least one sideboard opening is received between the liner edge portion and the inner sideboard panel, wherein the liner member is hidden by the ice surface formed in the rink area.

3. The ice rink structure as described in aspect 2, wherein the liner edge portion extends between the inner sideboard panel and the outer sideboard panel.

4. The ice rink structure as described in aspect 3, wherein when the plurality of sideboard sections are assembled, the liner member is substantially pinched and stretched between the inner sideboard panel and the outer sideboard panel of each of the plurality of sideboard sections.

5. The ice rink structure as described in any one of aspects 1 to 4, wherein the inner sideboard panel and the outer sideboard panel are substantially geometrically identical to each other.

6. The ice rink structure as described in any one of aspects 1 to 5, wherein each of the plurality of sideboard sections is formed by complementary assembling the inner sideboard panel and the outer sideboard panel, the outer sideboard panel being vertically inverted compared to the inner sideboard panel.

7. The ice rink structure as described in any one of aspects 1 to 6, wherein the inner sideboard panel and the outer sideboard panel further comprises:

a rim portion located at an upper panel end, and a planar portion extending between a lower panel end and the upper panel end, the rim portion and the planar portion being substantially perpendicular, the inner sideboard panel and the outer sideboard panel being substantially L-shaped.

8. The ice rink structure as described in aspect 7, wherein when the sideboard is assembled and positioned on the ground surface, for each of the plurality of sideboard sections, the planar portion of the outer sideboard panel abuts the ground surface, the lower panel end of the inner sideboard panel is nested in a receiving recess of the rim portion of the outer sideboard panel, and the lower panel end of the outer sideboard panel is nested in a receiving recess of the rim portion of the inner sideboard panel.

9. The ice rink structure as described in any one of aspects 1 to 8, wherein the inner sideboard panel and the outer sideboard panel further comprises a plurality of rib members to rigidify the panel.

10. The ice rink structure as described in aspect 9, wherein the rib members extend substantially vertically along the panel.

11. The ice rink structure as described in aspect 7, wherein the at least one sideboard opening is provided proximal the lower panel end of the planar portion.

12. The ice rink structure as described in aspect 11, wherein the at least one sideboard openings are distributed in a plurality of rows.

13. The ice rink structure as described in any one of aspects 1 to 12, further including a plurality of anchor members securable to the sideboard and configured to engage the ground surface to secure the sideboard to the ground surface.

14. The ice rink structure as described in aspect 13, wherein each of the plurality of anchor members comprises sideboard engaging projections extending upwardly from the anchor member, the sideboard engaging projections being engageable in a corresponding receiving recess of the outer sideboard panels.

15. The ice rink structure as described in aspect 13 or 14, wherein each of the plurality of anchor members comprises a forward portion for receiving the rim portion of the outer sideboard panel.

16. The ice rink structure as described in any one of aspects 13 to 15, further comprising a sideboard section connector to secure two consecutive sideboard sections together, wherein the sideboard section connector is securable to the inner sideboard panel of the two consecutive sideboard sections and to the anchor member.

17. The ice rink structure as described in aspect 16, wherein the sideboard section connector includes a top hook-shaped portion and an elongated shaft member extending away from the top hook-shaped portion.

18. The ice rink structure as described in aspect 17, wherein the sideboard section connector further includes a pair of sideboard-engaging projections extending downwardly from the top hook-shaped portion.

19. The ice rink structure as described in aspect 18, wherein each of the sideboard-engaging projection is sized and shaped to engage a corresponding connector-receiving opening defined in the inner sideboard panels.

20. The ice rink structure as described in any one of aspects 1 to 19, wherein the inner sideboard panel and the outer sideboard panel further comprises, at a first lateral end, a female connector, and at a second lateral end opposite to the first lateral end, a male connector, wherein the male connector and the female connector are complementary fitting together, to engage and secure two adjacent panels.

21. The ice rink structure as described in aspect 20, wherein complementary fitting together the male connector and the female connector comprises engaging a bottom sideboard end of a first sideboard section above a top sideboard end, opposite the bottom sideboard end of a second sideboard section, the first sideboard section and the second sideboard section being adjacent, and engage slidably downwardly the male connector of the second sideboard section in the female connector of the first sideboard section.

22. The ice rink structure as described in aspect 20 or 21, wherein the inner sideboard panel and the outer sideboard panel further comprises ridges on a top surface of the panel.

23. The ice rink structure as described in aspect 22, wherein the inner sideboard panel and the outer sideboard panel are bendable to form a curved sideboard section.

24. The ice rink structure as described in aspect 23, further comprising a plurality of straight sideboard sections and a plurality of curved sideboard sections.

25. The ice rink structure as described in aspect 24, wherein when a straight sideboard section is adjacent to a curved sideboard section, a straight-to-curved connecting member further connects the lateral ends of the outer sideboard panels together to compensate the space created by the curve.

26. The ice rink structure as described in aspect 24 or 25, wherein when a curved sideboard section is adjacent to another curved sideboard section, a curved-to-curved connecting member further connects the lateral ends of the outer sideboard panels together to compensate the space created by the curve.

27. The ice rink structure as described in any one of aspects 1 to 26, wherein the sideboard is disposed in a loop and the rink area is defined within the loop.

28. The ice rink structure as described in any one of aspects 1 to 27, wherein the ice rink structure is an ice skating rink structure.

29. A kit for an ice rink structure, the kit comprising:

a sideboard securable to a ground surface and delimiting a rink area adjacent the sideboard for receiving water such that an ice surface is formed in the rink area by freezing of the water, the sideboard being hollow and having a sideboard cavity defined therein, the sideboard including a plurality of sideboard sections disposable side-by-side and securable together; and a liner member deployable across the rink area to receive water to be frozen, the liner member including an outer liner edge and a liner edge portion extending from the outer liner edge towards a center of the liner member, the liner edge portion being positionable such that it extends into the sideboard cavity, wherein each of the plurality of sideboard sections comprises an inner sideboard panel facing towards the rink area and an outer sideboard panel spaced from the inner sideboard panel, away from the rink area, to form the sideboard cavity therebetween, wherein at least one of the inner sideboard panels comprises at least one sideboard opening proximal a bottom sideboard end for providing fluid communication between the rink area and the sideboard cavity to allow water from the rink area to enter the sideboard cavity and be received between the liner edge portion of the inner sideboard panel.

30. A method for constructing an ice rink using an ice rink structure, the method comprising:

positioning a plurality of outer sideboard panels of a plurality of sideboard sections end-to-end to delimit a rink area adjacent the plurality of sideboard sections;

deploying a liner member across the rink area such that a liner edge portion of the liner member extends over the outer sideboard panels; and positioning a corresponding inner sideboard panel over each one of the outer sideboard panels such that the liner edge portion extends through a sideboard cavity formed between the inner and outer sideboard panels and such that the liner edge portion is held between the inner and outer sideboard panels.

31. The method as described in aspect 30, wherein positioning a plurality of outer sideboard panels further comprises engaging a lower panel end a of a first outer sideboard panel above an upper panel end of a second outer sideboard panel, the first outer sideboard panel and the second outer sideboard panel being adjacent, and engage slidably downwardly a male connector of the second outer sideboard panel in a female connector of the first outer sideboard panel.

32. The method as described in aspect 30 or 31, wherein positioning a plurality of inner sideboard panels further comprises engaging a lower panel end of a first inner sideboard panel above an upper panel end of a second inner sideboard panel, the first inner sideboard panel and the second inner sideboard panel being adjacent, and engage slidably downwardly a male connector of the second inner sideboard panel in a female connector of the first inner sideboard panel.

33. The method as described in any one of aspects 30 to 32, further comprising securing a plurality of anchor members to the sideboard and to a ground surface to secure the sideboard to the ground surface.

34. The method as described in aspect 33, further comprising securing a sideboard section connector between two consecutive sideboard sections, and further securing the sideboard section connector to the anchor member.

35. An ice rink structure comprising:

a sideboard being securable to a ground surface and delimiting a rink area intended to receive water thereon, so as to form a resulting corresponding ice surface about the rink area, the sideboard being formed with a plurality of sideboard sections being disposable and connectable to one another, side-by-side, each sideboard section including a pair of inner and outer sideboard panels, said inner and outer sideboard panels being complementary to one another so as to provide each sideboard section with an inner sideboard cavity capable of receiving water, a bottom portion of at least one corresponding inner sideboard panel sideboard panel being provided with at least one sideboard opening, said at least one sideboard opening being in fluid communication between the rink area and the inner sideboard cavity so as to allow water to compensatively flow thereinbetween (for example, water can compensatively flow between the rink area and inner sideboard cavity, and/or vice versa, via the at least one sideboard opening).

36. An ice rink structure according to any one of the preceding aspects, wherein the ice rink structure includes a liner member being positioned, shaped and sized to substantially cover the rink area, the liner member having at least one liner edge portion extendable between the inner and outer sideboard panels of the plurality of sideboard sections, inside inner sideboard cavities thereof, for substantially containing water over the liner member and passing through the at least one sideboard opening.

37. An ice rink structure according to any one of the preceding aspects, wherein each sideboard panel is substantially L-shaped, including a planar portion and a panel end, and wherein a distal end portion of the outer sideboard panel overlaps over a lower panel end of the inner sideboard panel, for selectively securing the liner member thereinbetween.

38. An ice rink structure according to any one of the preceding aspects, wherein a distal end portion of the inner sideboard panel overlaps over an upper panel end of the outer sideboard panel, for selectively securing an outer liner edge of the liner member thereinbetween.

39. An ice rink structure according to any one of the preceding aspects, wherein the at least one sideboard opening includes a plurality of sideboard openings disposed about the at least one corresponding inner sideboard panel.

40. An ice rink structure according to any one of the preceding aspects, wherein the sideboard openings are provided along different rows of sideboard openings disposed along the at least one corresponding inner sideboard panel.

41. An ice rink structure according to any one of the preceding aspects, wherein a corresponding flow rate of water provided by each row of sideboard openings is different, with a flow rate of water of a first given row of sideboard openings being greater than that of a second higher given row of sideboard openings.

42. An ice rink structure according to any one of the preceding aspects, wherein the at least one corresponding inner sideboard panel includes a plurality of inner sideboard panels of different sideboard sections provided along the side board.

43. An ice rink structure according to any one of the preceding aspects, wherein the inner and outer sideboard panels are substantially identical to one another, so as to connectable onto one another in an inverted manner, and so as be interchangeable within the plurality of sideboard sections.

NUMERAL REFERENCES OF THE ELEMENTS SHOWN IN THE DRAWINGS

10 ice rink
100 ice rink structure
150 rink area
200 sideboard
202 bottom sideboard end
204 top sideboard end
208 straight sideboard section
210 curved sideboard section
220 inner sideboard panel
222 upper panel end
224 lower panel end
226 planar portion
229 ridges
230 exterior face
232 interior face
228 rim/base portion
235 hook-shaped end portion
236 top face
237 left and right connector recesses
239 connector-receiving openings
233*a*, 233*b* inner sideboard triangular panels
234 rib members
238*a*, 238*b* lateral ends
240 outer sideboard panel
242 outer openings
246*b* upper anchor-receiving openings
246*a* lower anchor-receiving openings
250 sideboard cavity
252 inner panel facing portion
254 outer panel facing portion
260 sideboard openings
262 opening rows
262*a* bottom opening row
262*b* top opening row
264 projecting rim
300 anchor member
302 ground-engaging member
312 forward portion
303 front end
304 upright member
305 front face
306 brace member
308 truss members
310 ground securing openings
311 rear ground securing opening
312 forward portion
314 sideboard engaging projection
320*a* upper sideboard-engaging hooks
320*b* lower sideboard-engaging hooks
350 receiving slot
352 pawl member
400 liner member
402 outer liner edge
404 liner edge portion
450 first lateral connecting portions
454*a*, 454*b* first and second substantially T-shaped projections
452 second lateral connecting portions
456*a* a first plurality of hook shaped members
456*b* second plurality of hook shaped members
458*a* first vertical receiving channels
458*b* second vertical receiving channels
500 sideboard section connector
502 top hook-shaped portion
504 elongated shaft member
508 sleeve portion
510 bottom connection tab
512 plurality of ridges
506 pair of sideboard-engaging projections
600 connecting members
610 straight-to-curved connecting member
612 rectangular central body
614 substantially T-shaped projection
616 T-shaped receiving channel
620 curved-to-curved connecting member
622 rectangular central body
624 T-shaped projection
626 T-shaped receiving channel
630, 632 first and second U-shaped portions
634 inner arm
636 outer arm
640 top surface
650 adjusting slot.

The invention claimed is:

1. An ice rink structure comprising:

a sideboard securable to a ground surface and delimiting a rink area adjacent the sideboard for receiving water such that an ice surface is formed in the rink area by freezing of the water, the sideboard being hollow and having a sideboard cavity defined therein, the sideboard including a plurality of sideboard sections disposable side-by-side and securable together, wherein each of the sideboard sections comprises an inner sideboard panel facing towards the rink area and an outer sideboard panel spaced from the inner sideboard panel, facing away from the rink area, to form the sideboard cavity therebetween, wherein at least one of the inner sideboard panels comprises at least one sideboard opening proximal a bottom sideboard end for providing fluid communication between the rink area and the sideboard cavity to allow water from the rink area to enter the sideboard cavity, the at least one sideboard opening being positioned such that, when water is received in the rink area to form the ice surface, at least a portion of the at least one sideboard opening is below a level of the water in the rink area to allow water from the rink area to enter the sideboard cavity through the at least one sideboard opening, such that a level of water in the sideboard cavity corresponds to the level of water in the rink area.

2. The ice rink structure as claimed in claim 1, wherein the inner sideboard panel and the outer sideboard panel are substantially geometrically identical to each other.

3. The ice rink structure as claimed in claim 1, wherein each of the plurality of sideboard sections is formed by complementary assembling the inner sideboard panel and the outer sideboard panel, the outer sideboard panel being vertically inverted compared to the inner sideboard panel.

4. The ice rink structure as claimed in claim 1, wherein each of the inner sideboard panel and the outer sideboard panel further comprises, at a first lateral end, a female connector, and at a second lateral end opposite to the first lateral end, a male connector, wherein the male connector and the female connector are complementary fitting together, to engage and secure two adjacent panels.

5. The ice rink structure as claimed in claim 1, wherein the sideboard is disposed in a loop and the rink area is defined within the loop.

6. The ice rink structure as claimed in claim 1, wherein the ice rink structure is an ice skating rink structure.

7. The ice rink structure as claimed in claim 1, wherein each of the inner sideboard panel and the outer sideboard panel further comprises:

a rim portion located at an upper panel end, and a planar portion extending between a lower panel end and the upper panel end, the rim portion and the planar portion being substantially perpendicular such that each of the inner sideboard panel and the outer sideboard panel is substantially L-shaped.

8. The ice rink structure as claimed in claim 7, wherein when the sideboard is assembled and positioned on the ground surface, for each of the plurality of sideboard sections, the planar portion of the outer sideboard panel abuts the ground surface, the lower panel end of the inner sideboard panel is nested in a receiving recess of the rim portion of the outer sideboard panel, and the lower panel end of the outer sideboard panel is nested in a receiving recess of the rim portion of the inner sideboard panel.

9. The ice rink structure as claimed in claim 7, wherein the at least one sideboard opening is provided proximal the lower panel end of the planar portion, and wherein the at least one sideboard opening comprises a plurality of sideboard openings disposed in a plurality of rows that extend substantially in a widthwise direction on the inner sideboard panel.

10. The ice rink structure as claimed in claim 1, further comprising a liner member extending across the rink area to receive water to be frozen, the liner member including an outer liner edge and a liner edge portion extending from the outer liner edge towards a center of the liner member, the liner edge portion extending into the sideboard cavity such that the water from the rink area entering the sideboard cavity through the at least one sideboard opening is received between the liner edge portion and the inner sideboard panel, wherein the liner member is hidden by the ice surface formed in the rink area.

11. The ice rink structure as claimed in claim 10, wherein the liner edge portion extends between the inner sideboard panel and the outer sideboard panel.

12. The ice rink structure as claimed in claim 11, wherein when the plurality of sideboard sections are assembled, the liner member is substantially pinched and stretched between the inner sideboard panel and the outer sideboard panel of each of the plurality of sideboard sections.

13. The ice rink structure as claimed in claim 1, further including a plurality of anchor members securable to the sideboard and configured to engage the ground surface to secure the sideboard to the ground surface.

14. The ice rink structure as claimed in claim 13, wherein each of the plurality of anchor members comprises sideboard engaging projections extending upwardly from the anchor member, the sideboard engaging projections being engageable in a corresponding receiving recess of the outer sideboard panels.

15. The ice rink structure as claimed in claim 14, further comprising a sideboard section connector to secure two consecutive sideboard sections together, wherein the sideboard section connector is securable to the inner sideboard panel of the two consecutive sideboard sections and to the anchor member.

16. The ice rink structure as claimed in claim 1, wherein each of the inner sideboard panel and the outer sideboard panel further comprises ridges on a top surface of the panel, and wherein the inner sideboard panel and the outer sideboard panel being bendable to form a curved sideboard section.

17. The ice rink structure as claimed in claim 16, further comprising a plurality of straight sideboard sections and a plurality of curved sideboard sections.

18. The ice rink structure as claimed in claim 17, wherein when a straight sideboard section is adjacent to a curved sideboard section, a straight-to-curved connecting member further connects lateral ends of the outer sideboard panels together to compensate a space created by the curve, and wherein when a curved sideboard section is adjacent to another curved sideboard section, a curved-to-curved connecting member further connects the lateral ends of the outer sideboard panels together to compensate the space created by the curve.

19. A kit for an ice rink structure, the kit comprising:

a sideboard securable to a ground surface and delimiting a rink area adjacent the sideboard for receiving water such that an ice surface is formed in the rink area by freezing of the water, the sideboard being hollow and having a sideboard cavity defined therein, the sideboard including a plurality of sideboard sections disposable side-by-side and securable together; and a liner member deployable across the rink area to receive water to be frozen, the liner member including an outer liner edge and a liner edge portion extending from the outer liner edge towards a center of the liner member, the liner edge portion being positionable such that it extends into the sideboard cavity, wherein each of the plurality of sideboard sections comprises an inner sideboard panel facing towards the rink area and an outer sideboard panel spaced from the inner sideboard panel, facing away from the rink area, to form the sideboard cavity therebetween, wherein at least one of the inner sideboard panels comprises at least one sideboard opening proximal a bottom sideboard end for providing fluid communication between the rink area and the sideboard cavity to allow water from the rink area to enter the sideboard cavity and be received between the liner edge portion of the inner sideboard panel.

20. A method for constructing an ice rink using an ice rink structure, the method comprising:

positioning a plurality of outer sideboard panels of a plurality of sideboard sections end-to-end to delimit a rink area adjacent the plurality of sideboard sections;

deploying a liner member across the rink area such that a liner edge portion of the liner member extends over the outer sideboard panels;

positioning a corresponding inner sideboard panel over each one of the outer sideboard panels such that the liner edge portion extends through a sideboard cavity formed between the inner and outer sideboard panels and such that the liner edge portion is held between the inner and outer sideboard panels; and receiving water in the rink area to form the ice surface, wherein at least one of the inner sideboard panels comprises at least one sideboard opening proximal a bottom sideboard end for providing fluid communication between the rink area and the sideboard cavity to allow water from the rink area to enter the sideboard cavity, the at least one sideboard opening being positioned such that at least a portion of the at least one sideboard opening is below a level of the water in the rink area to allow water from the rink area to enter the sideboard cavity through the at least one sideboard opening, such that a level of water in the sideboard cavity corresponds to the level of water in the rink area.

* * * * *